US007596478B2

(12) United States Patent
Newman et al.

(10) Patent No.: US 7,596,478 B2
(45) Date of Patent: Sep. 29, 2009

(54) METHOD OF FORMING A FIRE RESISTANT STRUCTURAL BEAM

(75) Inventors: Gerald M. Newman, Ascot (GB); Alan Victor Pottage, Scarborough (GB)

(73) Assignee: Fabsec Ltd., Leeds (GB)

( * ) Notice: Subject to any disclaimer, the term of this patent is extended or adjusted under 35 U.S.C. 154(b) by 0 days.

(21) Appl. No.: 10/491,222

(22) PCT Filed: Sep. 26, 2002

(86) PCT No.: PCT/GB02/04366

§ 371 (c)(1),
(2), (4) Date: Nov. 26, 2004

(87) PCT Pub. No.: WO03/027412

PCT Pub. Date: Apr. 3, 2003

(65) Prior Publication Data

US 2005/0066614 A1 Mar. 31, 2005

(30) Foreign Application Priority Data

Sep. 26, 2001 (GB) ..... 0123136.4

(51) Int. Cl.

| | |
|---|---|
| ***G06F 17/50*** | (2006.01) |
| ***G06G 7/48*** | (2006.01) |
| ***E04B 1/68*** | (2006.01) |
| ***E04C 2/38*** | (2006.01) |
| ***E04C 3/00*** | (2006.01) |

(52) U.S. Cl. ..... 703/7; 703/1; 52/831; 52/396.01; 52/656.3

(58) Field of Classification Search ..... 52/720.1, 52/831, 396.01, 783.13, 784.11, 656.3; 703/1, 703/7

See application file for complete search history.

(56) References Cited

U.S. PATENT DOCUMENTS

| | | | | |
|---|---|---|---|---|
| 4,251,973 | A | 2/1981 | Paik | |
| 4,493,945 | A * | 1/1985 | Feldman | 174/68.3 |
| 5,557,710 | A | 9/1996 | Amdursky et al. | |
| 5,654,900 | A | 8/1997 | Ratner | |

FOREIGN PATENT DOCUMENTS

| | | |
|---|---|---|
| EP | 0 789 310 A2 | 8/1997 |
| GB | 930176 | 7/1963 |
| GB | 1326778 | 8/1973 |

(Continued)

OTHER PUBLICATIONS

"European Experiences in Fire Design of Structural Steel", Yngve Anderberg, 1998.*

(Continued)

*Primary Examiner*—Paul L Rodriguez
*Assistant Examiner*—Nithya Janakiraman
(74) *Attorney, Agent, or Firm*—Marshall, Gerstein & Borun LLP

(57) ABSTRACT

A method, and the resultant apparatus, for designing a fire resistant structural beam, such as a computer-aided design of a fabricated steel beam having an intumescent coating material, by obtaining a number of values for a number of physical parameters of the structural beam, including reading temperature information that comprise empirical information derived from heating a structural beam and a number of temperatures at a number of locations.

25 Claims, 15 Drawing Sheets

FOREIGN PATENT DOCUMENTS

| | | |
|---|---|---|
| GB | 1452063 | 10/1976 |
| GB | 2270706 | 3/1994 |
| GB | 2 356 366 | 5/2001 |
| GB | 2356366 | 5/2001 |
| WO | WO 01/52119 | 7/2001 |
| WO | WO 01/52119 A1 | 7/2001 |

OTHER PUBLICATIONS

"Integrity of Structural Steel After Exposure to Fire", R.H.R. Tide. Engineering Journal, First Quarter, 1998.*

Design of steel beams and joists, South Bank University, Faculty of the Built Environment, pp. 1-23, Mar. 27, 1995.

* cited by examiner

METHOD OF FORMING A FIRE RESISTANT STRUCTURAL BEAM

FIELD OF THE DISCLOSURE

This invention relates to a method of designing a structural beam, such as a fabricated steel beam, and to a structural beam designed by the method. The invention particularly but not exclusively relates to fabricated steel beams for composite or non-composite structures of concrete and steel.

BACKGROUND

It is known that the strength of steel starts to fall when the temperature of the steel exceeds 500° C. or so, and falls to zero at about 1000° C. or so. As building fires may exceed these temperatures, it is clearly desirable that structural beams made of steel retain sufficient strength to avoid deformation for a period which is sufficiently long for, for example, the building to be evacuated. Typical fire protection periods for structural beams, particularly floor supporting beams, vary from 30 to 120 minutes. The fire resistant qualities of the beam can be increased by increasing the physical characteristics, that is the physical dimensions, of the beam and/or by insulating the beam such that in the event of a fire, the rate of temperature rise of the beam will be reduced to provide the required length of fire resistance. It is known, for example, to provide a suitable fire resistant cladding, which is built around the beam on site. This however actually requires additional on-site work, which may extend the time required to commission a building, with attendant financial cost.

It is also known to apply a fire protection material to a beam, which is subject to an intumescent reaction when heated or in the presence of fire. When heated, the material undergoes an interaction between its components which causes the material to form a char, the thickness of which is up to 50 times that of the original coating of the fire protection material. The char has insulating properties and so decreases the rate of temperature rise in the steel element to which it is applied. Hence, a structural beam may be supplied with desired fire resistant values without necessarily having to increase the physical dimensions of the beam.

Typically, intumescent fire protection material is applied as a coating to a structural beam by being supplied as a spray. The resulting coating has a thickness typically in the range of 250 to 2200 microns, and thicker if need be. The spray may be applied on site or off site. The advantage of applying the coating off site is that a fully finished structural beam is supplied to the construction site which reduces the work required on site, and hence shortens the construction period and reduces the cost.

Conventionally, when assessing the thickness of fire protection material required, an engineer will consult an appropriate reference book, such as "Fire Protection for Structural Steel in Buildings" published by the Association of Specialist Fire Protection and the Steel Construction Institute. This will suggest an appropriate thickness of intumescent coating to be applied to a beam depending on the section factor of the beam, that is its perimeter distance divided by its area, and the length of time for which fire resistance is required.

There are difficulties in this approach in that it does not fully take account of cellular beams or other structural beams provided with apertures, and it does not consider parameters such as cell spacing or web slenderness ratio.

SUMMARY OF THE DISCLOSURE

An aim of the present disclosure is to reduce or overcome one or more of the above problems. In this specification, although "beams" and "structural beams" are referred to, it will be apparent that the invention may be used with any appropriate structural component.

According to a first aspect of the disclosure, a method of designing a fire resistant structural beam is provided, comprising obtaining a plurality of values for a plurality of physical parameters of the structural beam, reading temperature information, performing an analysis step to calculate a property of the structural beam in accordance with the temperature information, and generating an output in accordance with the analysis step.

The temperature information may comprise empirical information derived from heating a structural beam.

The temperature information may comprise a plurality of temperatures at a plurality of locations, and where the temperature information for a position disposed between two or more of said locations is calculated by interpolating the temperatures at the two or more locations.

The analysis step may comprise performing calculations at a plurality of spaced locations along the structural beam.

The spaced locations may comprise sections through the structural beam.

The spaced locations may be equidistant along the length of said structural beam.

The structural beam may comprise one or more apertures and the step of obtaining a plurality of values for a plurality of physical parameters of the structural beam comprises obtaining aperture information comprising the location and size of the or each aperture.

The step of reading the temperature information may comprise reading modifying factor information in accordance with the aperture information and modifying the temperature information in accordance with the modifying factor information.

The modifying factor information may comprise a plurality of factors at a plurality of locations and the step of modifying the temperature information in accordance with the modifying factor information comprising multiplying the temperature information by the modifying factor information.

The plurality of factors may be in the range 1.05 to 1.5.

The temperature information may comprise empirical information derived from heating a structural beam comprising a plain beam and wherein the modifying factor information comprises empirical information derived from heating a structural beam provided with one or more apertures.

The analysis step may further comprise performing additional calculations in the vicinity of the aperture.

The additional calculations may comprise calculating one or more of; the shear resistance of the structural beam, the bending resistance of the structural beam, Vierendeel bending resistance, web buckling.

The method may comprise the step of calculating the required thickness of intumescent coating to avoid failure of the structural beam with a selected period of time, the fire resistance time.

The method may comprise the step of identifying a failure mode of the structural beam and calculating the thickness of intumescent coating required to avoid the failure mode.

The method may comprise the step of identifying the location where said failure mode occurs and calculating the required thickness at that location.

The method may comprise the step of performing said further step for a plain beam and then performing the additional calculations in accordance with the required thickness.

The output step may comprise comparing one or more values of said one or more properties with a predetermined criterion and generating an output accordingly.

The method may comprise the step of performing said analysis step for the structural beam in the cold condition.

The method may comprise the step of modifying the values for a plurality of physical parameters of the structural beam in accordance with the output and performing the method in accordance with the modified values.

According to a second aspect of the disclosure, a computer program for performing the above method is provided.

According to a third aspect of the disclosure, a structural beam where designed by a method according to a first aspect of the disclosure is provided.

Thus, in accordance with this disclosure, is provided a fabricated steel beam, which may be for composite steel structures with metal deck floors, comprising lower and upper flanges and web produced from steel plate. A coating, of intumescent material, is applied of a thickness calculated on the basis of failure mechanism of at least one of the individual components of the beam. The development of understanding of these failure mechanisms is supported by fire tests.

BRIEF DESCRIPTION OF THE DRAWINGS

The disclosure will now be described by way of example only with reference to the accompanying drawings where.

DETAILED DESCRIPTION OF THE PREFERRED EMBODIMENTS

Figure 1:
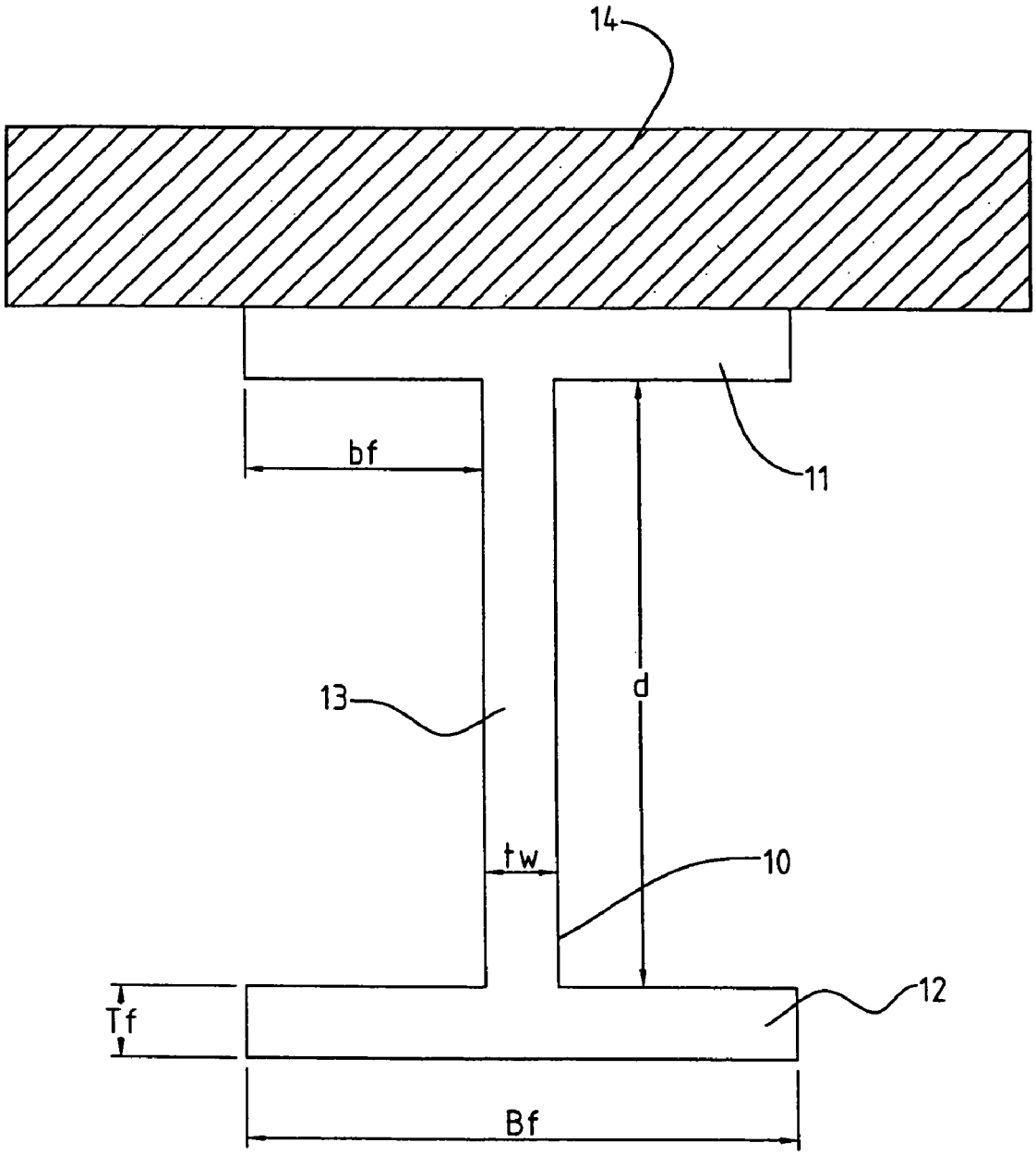
FIG. 1 is a section through a hot-rolled beam of known type.

Referring now to FIG. 1, a hot rolled structural beam is generally shown at 10 comprising an upper flange 11 and a lower flange 12 connected by a web 13. The beam 10 supports a concrete floor slab shown at 14 in conventional manner. The width of the lower flange is given as $B_f$, the lower flange thickness as $T_f$, the web thickness as $t_w$, the web height as d, and the internal width of the upper and lower flange as $b_f$. Conventionally, for a hot-rolled beam, the thickness of the required fire protection coating is calculated on the basis of the section factor of the whole beam, that is the ratio of the heated perimeter to the total cross sectional area of the beam. For the beam shown in FIG. 1 this is calculated as;

$$\frac{H_p}{A} = \frac{4T_f + 4b_f + 2d + 2B_f}{t_w d + 2B_f T_f}$$

Where a beam has a small section factor, in general a low coating thickness is required since the structural beam itself contains sufficient material to withstand a relatively long period of heating, whereas a low section factor indicates that the beam will heat up relatively quickly when exposed to a source of heat and thus fail more quickly, requiring a higher coating thickness.

Figure 2:
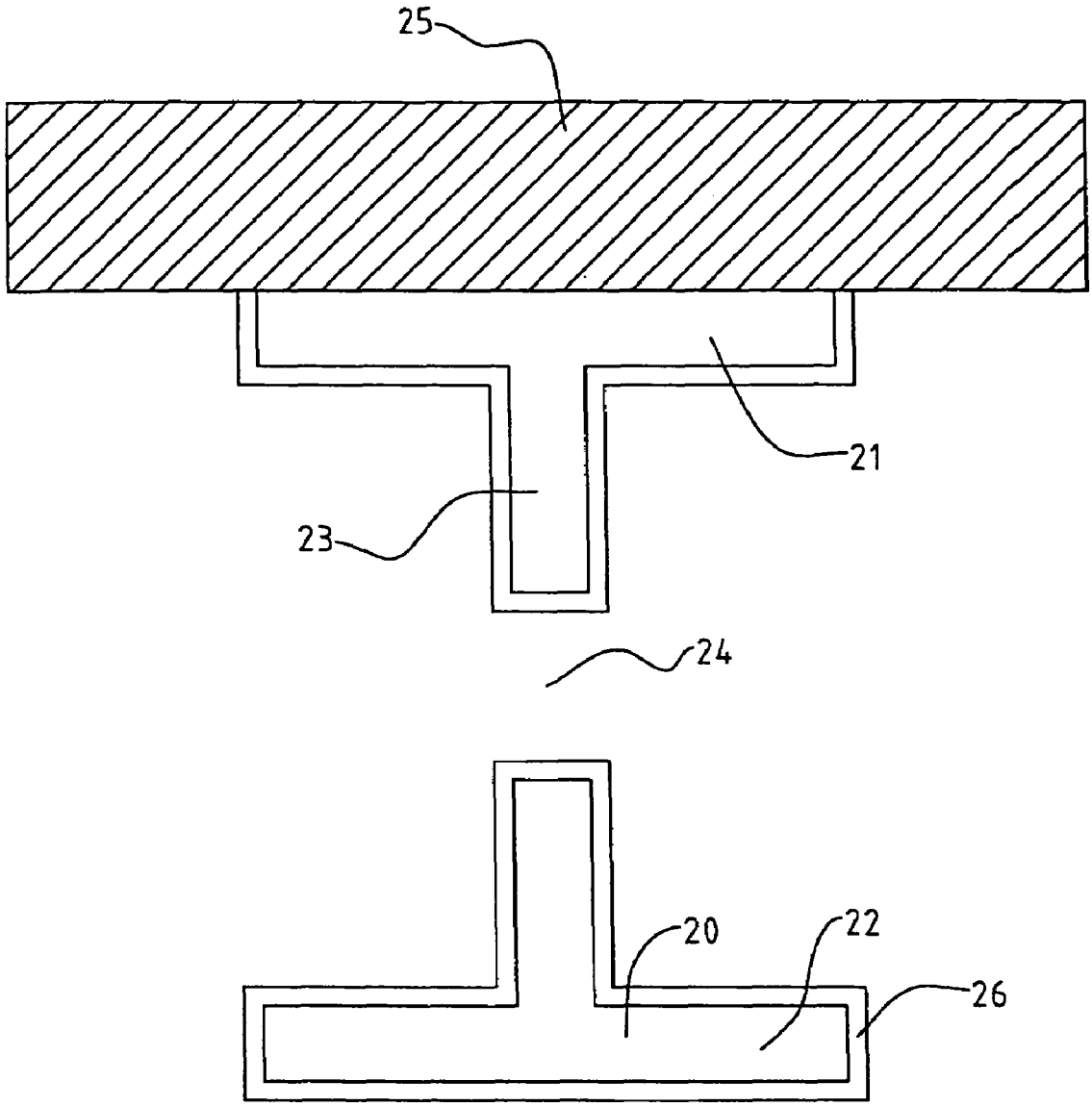
FIG. 2 is a section through a fabricated structural beam.
Figure 3:
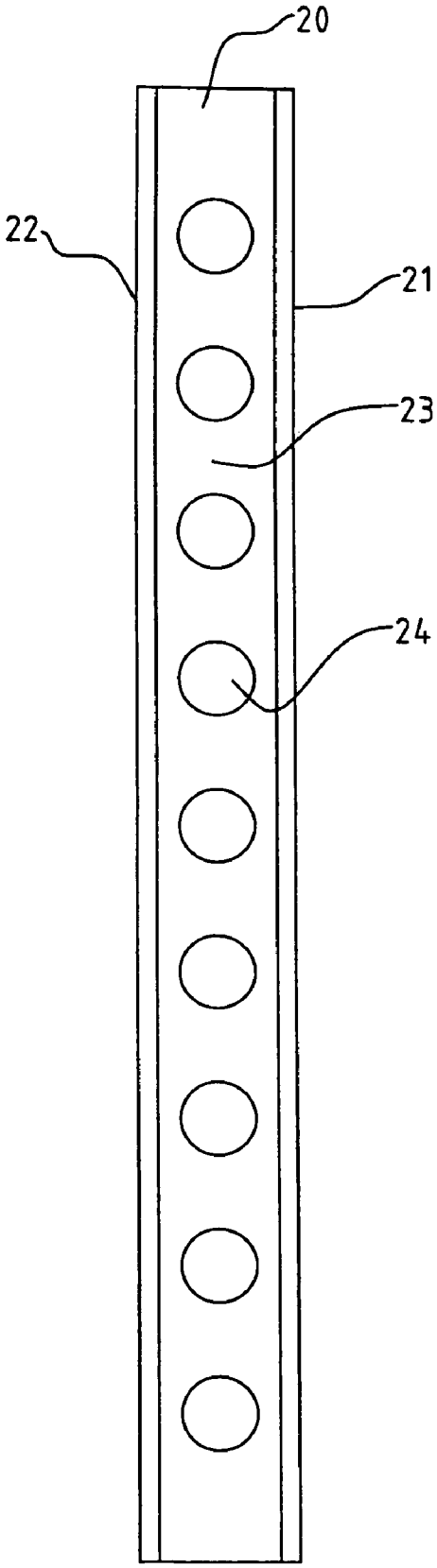
FIG. 3 is a side view of the structural beam of FIG. 2.

As discussed hereinbefore, this method of calculating the required thickness of intumescent coating is not suitable for beams provided with apertures, and may also not be suitable for fabricated beams which provide a great deal of flexibility in providing beams with differing sizes of upper and lower apertures and web. As shown in FIGS. 2 and 3, a fabricated structural beam is shown comprising an upper flange 21, a lower flange 22 and a web 23 in which a plurality of apertures 24 are provided. The structural beam 20 supports a floor slab 25. The structural beam 20 is further provided with a coating 26 of an appropriate intumescent material. Such a structural beam 20 is generally referred to as a fabricated beam or girder.

Conventionally, where a structural beam is provided with apertures 24, a guide used by engineers is that the intumescent coating 26 may be calculated from that required by a plain beam such as that shown in FIG. 1, with the thickness increased by 20%. However, unexpectedly, this thickness of coating may not be sufficient for providing the desired fire protection, as tests of fabricated beams, both plain and provided with apertures, show that modes of failure including bending and shear buckling occur. In particular, the web post is particularly important, and failure mode is strongly influenced by the web slenderness ratio and cell spacing.

The method of designing a structure of the present disclosure therefore uses empirical temperature information from fire tests of beams to find the temperature distribution of a heated beam and perform an analysis of one or more properties of the structural beam in accordance with the temperature information.

The method may also use standard codes in the analysis such as BS 5950 Part 8 or corresponding Eurocodes.

The method is discussed with reference to FIG. 4. At step 30, the beam parameters, that is the physical dimensions of the beams including the size and location of any apertures, and the required fire resistance time are obtained. The beam parameters may be entered by a designer, or may be obtained from a beam design program or otherwise. The fire resistance time in time within which the beam may not fail, and is conventionally one of 30 minutes, 60 minutes, 90 minutes or 120 minutes.

At step 31, the temperature information for a plain beam, that is a beam without apertures, having the same dimensions and material obtained in FIG. 30 is read. In the fire tests as discussed in more detail below, temperature data were obtained by locating thermocouples at different points on a beams with plain and/or cellular webs, and thus the temperature information comprises a plurality of temperatures at a plurality of locations after a given time has elapsed, for example 30 minutes. Because the temperature information will be for a particular distribution of points on a plain beam, to enable the properties of the beam to be calculated at points between these locations at 31, where necessary, an interpolation is performed for points between the locations and associated temperatures to calculate the temperature distribution across the beam where required. Advantageously, it has been found that the interpolation may be a simple linear interpolation, which is computationally simple and thus quick to perform. In a preferred implementation, the temperature information comprises temperature information derived from the experimental data by performing the linear interpolation step. Thus, in performing the method the temperature information may be used without requiring further interpolation.

In the present example, for each beam size sets of temperature information at 30 minutes, 60 minutes, 90 minutes and 120 minutes are provided, and the appropriate set is read depending on the selected fire resistance time.

At step 32, an analysis is performed to calculate the properties of the beam at one or more locations and at each location, at the temperature read in step 31. The properties of the beam may comprise such checks as vertical shear checks, interaction of vertical shear and bending moment, a check for lateral or torsional buckling, a concrete longitudinal shear check, under normal condition, and, in its construction position, the interaction of vertical shear and bending moment and lateral torsional buckling. The calculations may generally be those used for a structural beam in the "cold", i.e. unheated condition but using a suitable value for the strength of the steel at the elevated temperature. These calculations are set out in our prior International patent application no. PCT/GB00/01324, the contents of which are incorporated herein by reference. It will be apparent that any other analysis or calculation of other properties to be performed as desired. Advantageously, the analysis may be performed at a plurality of longitudinally spaced locations along the beam, and in particular where each location comprises a section through the beam, preferably transverse to the longitudinal axis, as set our in our prior application. The location or section of the structural beam with the poorest physical properties, is identified, that is the likely failure mode of the beam, and at step 33, the required thickness of intumescent material necessary to protect that section of the beam is calculated, such that the temperature rise of that section of the beam to its failure condition is delayed for the fire resistance time entered at step 30. From the required thickness of the char, the thickness of intumescent material to be applied to the beam can be calculated, and is hereinafter referred to as the required coating thickness.

At step 34, where the beam 22 is provided with apertures 24, it is necessary to further check the beam in the vicinity of the apertures. At step 34, modifying factor information is read for locations around and in the vicinity of apertures of a beam. In the present example, sets of modifying factor information are provided for apertures of different types, for example for apertures having round, rectangular or "obround" shapes, and different cell spacings. Modifying factors are stored for locations around and in the vicinity of the aperture. The modifying factor information is thus read from the appropriate set relating to the aperture. From the fire tests as discussed below, it has been found that the temperature around an aperture in a structural beam is higher that in a similar location for a plain beam having otherwise the same dimensions, seemingly because of the smaller amount of steel available to be heated and to sink heat away from the heated regions, and also potentially because of the greater perimeter area of the beam, although other factors may of course be relevant. Thus, the modifying factor information comprises a plurality of modifying factors associated with a plurality of locations. As in step 31, where necessary a linear or other interpolation may be performed between locations to provide modifying factors for required points on a beam, although in the preferred implementation the interpolation is performed when establishing the modifying factor information from the experimental data such that no further interpolation is required. The modifying factors are dimensionless numbers, and empirically may be derived from measuring the temperature at corresponding points on a beam provided with apertures and a plain beam and calculating the ratio of the temperatures. In the present invention, it has been found that the modifying factors are in general in the range 1.05 to 1.5. It will be apparent that this relative increase in temperature means that the presence of apertures in a beam may cause a beam to be very much weaker than would be conventionally expected. At step 35, the temperature information is therefore multiplied by the modifying factor information.

At step 36, an analysis of one or more properties of the beam is performed in the vicinity of the apertures in accordance with the increased temperature values introduced by the modifying factor. As discussed in detail below, the analysis may conclude calculating parameters such as shear resistance of the beam at the opening and the Vierendeel resistance around the aperture. At step 37, an output is generated in accordance with the analysis step 36. For example, the output may generate a unity factor for property at each location, where a unity factor is a dimensionless number arising from the comparison of the value of the property with a predetermined criterion, and where a value of less than 1 indicates that the value of the property for that location of the beam is acceptable, and where a value of one or greater indicates that the value of the property at that location is unacceptable. By generating and outputting unity factors in this way, it is thus easy for a designer to identify sections or locations of a beam where property is unacceptable and moderate the beam parameter and/or the thickness of the intumescent material as required. The method of FIG. 4 may be performed iteratively to provide a beam having the desired physical parameters and fire resistance time.

Advantageously, at step 37, the method may comprise the step of generating a cost factor or cost index. This may be calculated from the physical dimensions of the beam, with associated cost implications for the quantity of steel required and manufacturing steps, and may also incorporate an indication of the cost of applying an intumescent coating 26. For example, the maximum thickness of a coat of intumescent material 26 applied in a single pass may be limited, and it may be more cost effective to slightly increase the physical dimensions of a beam rather than performing to two or more spring steps to build up a required thickness of a coating 26. This assists in avoiding un-economical designs, such as those including relatively small thin structural beams with an excessively thick intumescent coating 26.

The method according to the invention thus permits a suitable design of beam to be arrived at, taking into account behavior of the web post, based on experimental data from tested beams.

Figure 4:
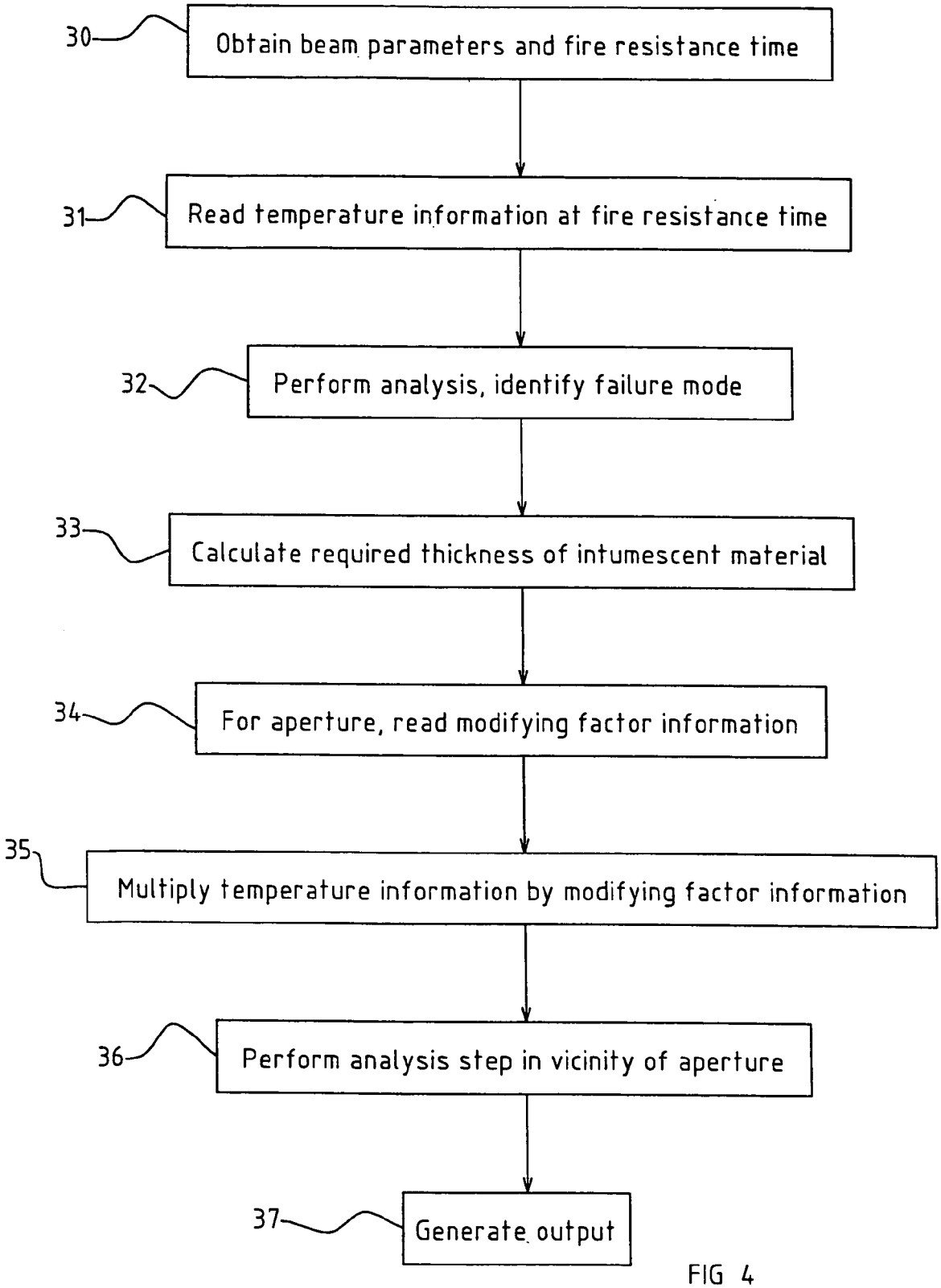
FIG. 4 is a flow chart illustrating a method embodying the present disclosure.

Advantageously, the method of FIG. 4 may treat the flanges 21, 22 and web 23 of the beam 20 independently. That is the temperature rise may be calculated for each part or "element" of the beam assuming a different char thickness and different thickness of intumescent coating for each part, taking into account the failure mechanism of each element. The determining factor for the thickness of intumescent coating at 26 can then be one of 1. Three coating thickness. Applying appropriate thickness to each individual element to prevent the mechanism likely to lead to structural failure for that element (within the fire resistance time required) or 2. Single coating thickness. By applying the highest coating thickness required by a single element to prevent failure (within the fire resistance time required) to all three elements or 3. Two coating thickness. By applying the coating thickness required to prevent mechanism likely to lead to structural failure for the worst case flange (within the fire resistance time required) to both flanges. Then to apply a different coating thickness similarly required for the web to prevent the mechanism likely to lead to structural failure (within the fire resistance time required).

The invention may incorporate stiffening elements in and around service holes in the web to prevent or delay certain types of disadvantageous failure mechanisms such as Virendeel bending or catastrophic shear. These stiffeners may be horizontal or vertical plate stiffeners, generally to be welded in place around apertures. In some cases, a circular aperture provided in the web of the beam may require strengthening in the fire condition. In such an eventuality a short length of circular hollow section (CHS) may provide the strengthening of appropriate outside diameter and wall thickness. The CHS should be placed inside the hole and the outside diameter should be sufficient to provide a close fit to the hole to allow the hollow section to be welded in place. Alternatively the circular stiffener may be formed from plate rolled to shape.

Advantageously, the method such as the embodiment illustrated in FIG. 4 may be incorporated in a general method of designing a beam such as that described in our earlier application. In an earlier application, a structural beam may be designed in the cold condition taking into account all loads etc., and then the fire resistance of the structural beam is performed by performing the same calculations, at the same locations if appropriate, at the higher temperature found in the temperature information.

Figure 5A:
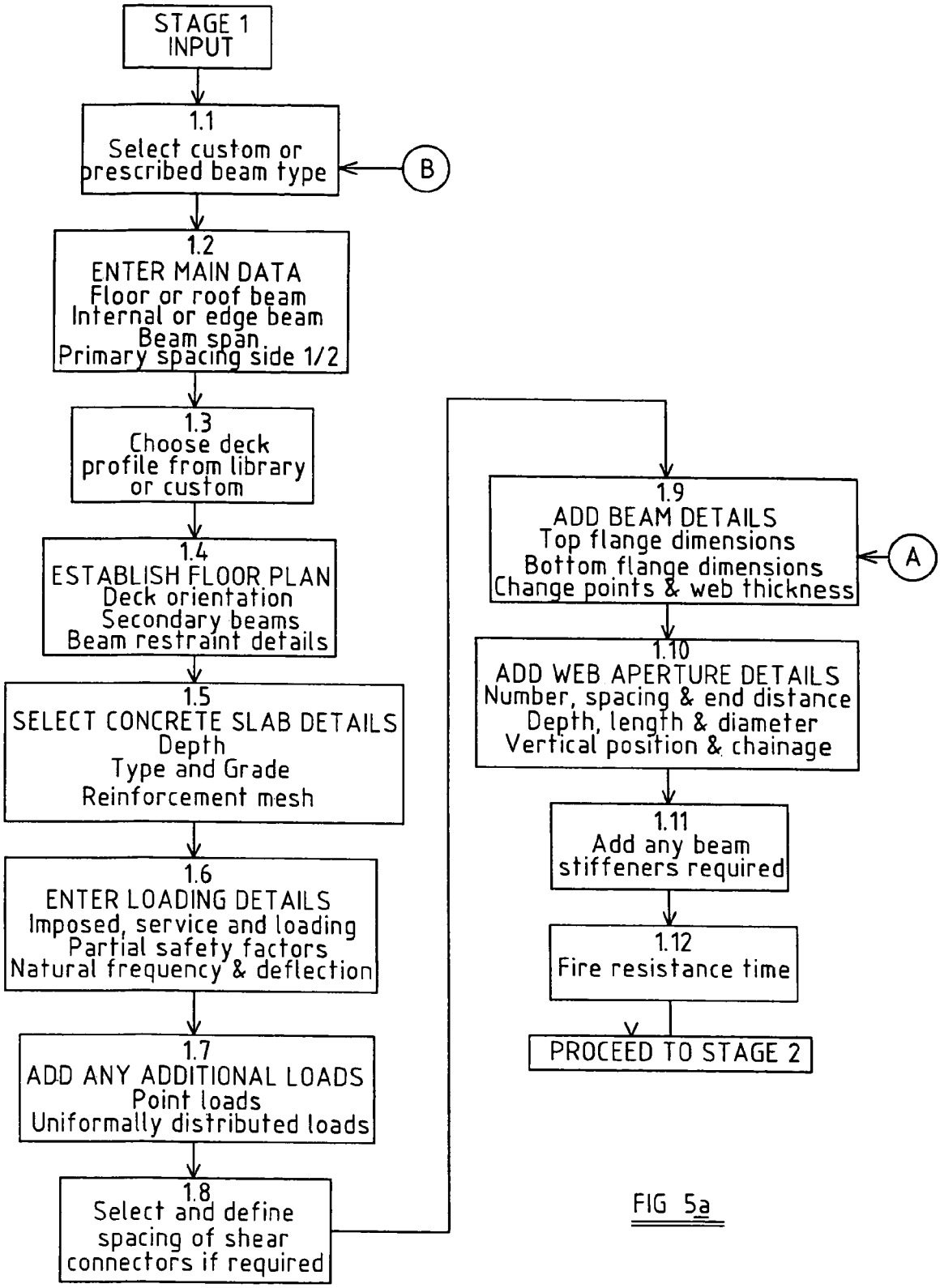
FIG. 5*a* is a flow chart of a first stage of a method of designing a beam.
Figure 5B:
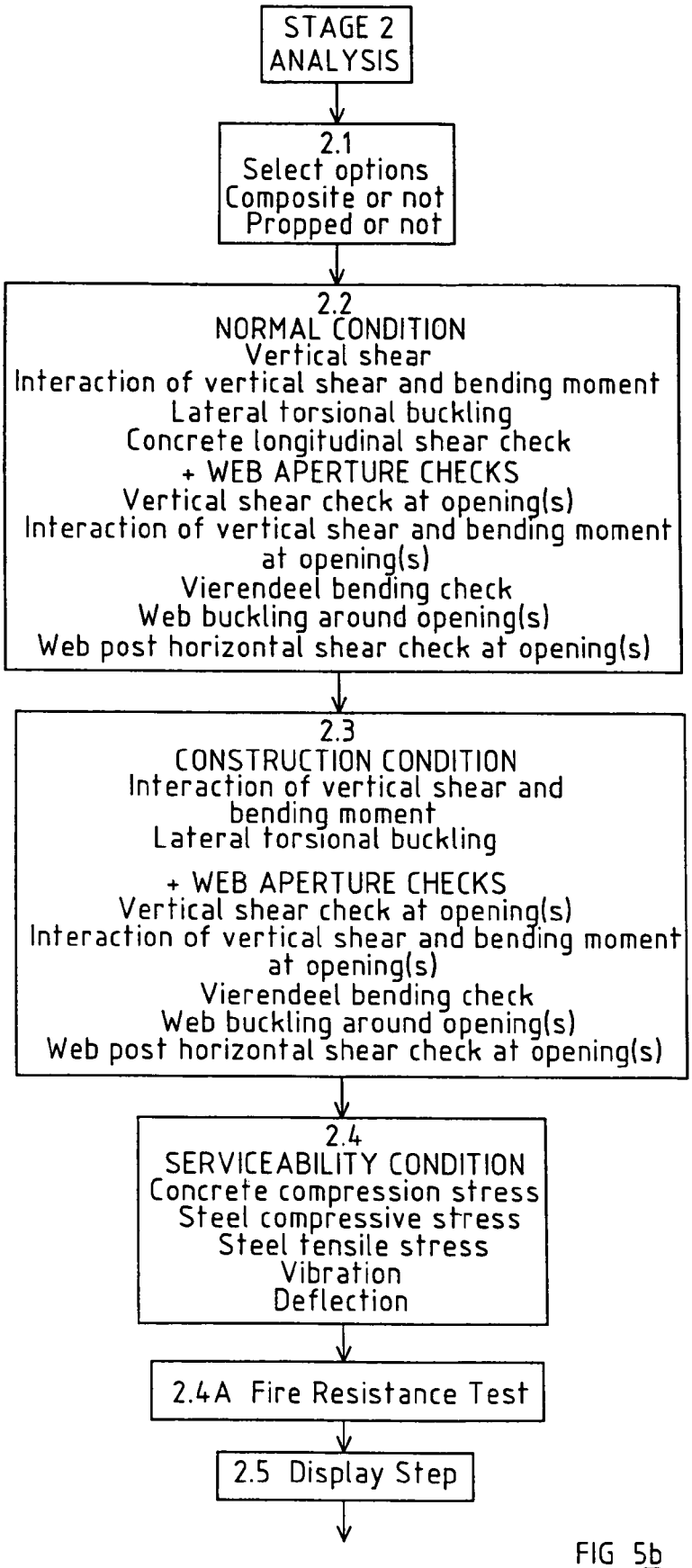
FIG. 5*b* is a flow chart of a second stage of a method of designing a beam.
Figure 5B:
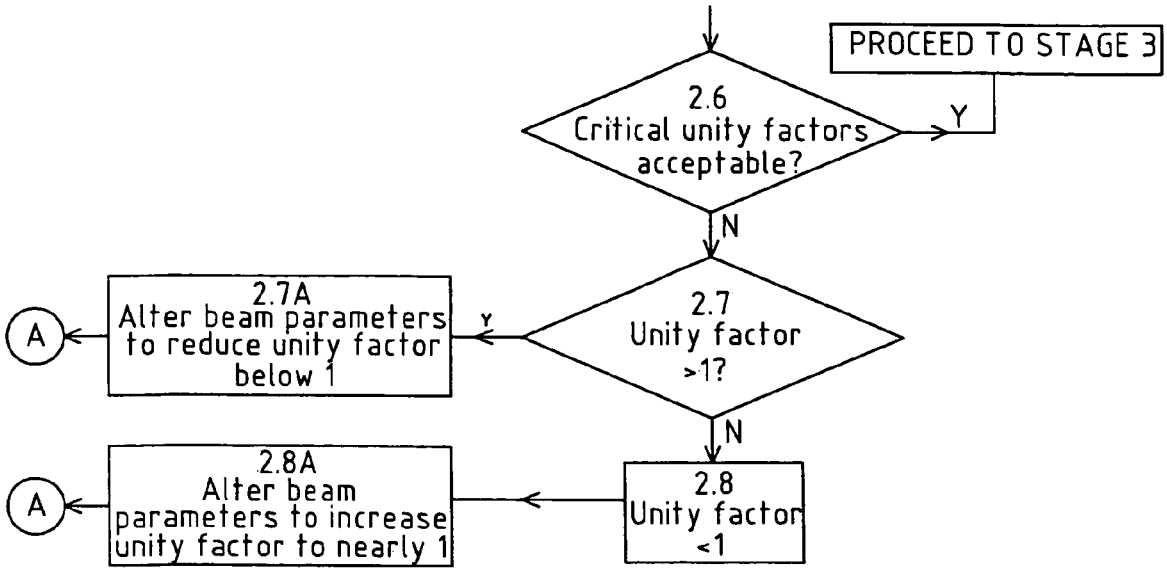
Figure 5C:
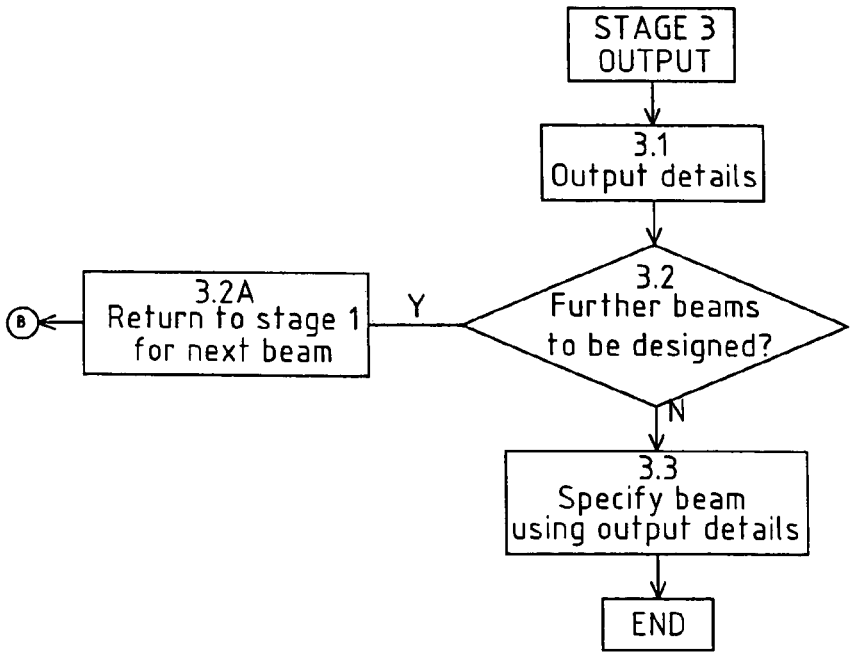
FIG. 5*c* is a flow chart of a third stage of a method of designing a structural beam.

Referring now to FIGS. 5*a* to 5*c*, the various steps of the method according to this invention are shown as a flow chart. The method may be broken down into three stages, a first, input stage as shown in FIG. 5*a*, an analysis stage shown in FIG. 5*b* and an output stage shown in FIG. 5*c*. In the present example, the method is envisaged as being performed by a computer program and designer.

In the input stage of the method, the relevant parameters of the beam and the load and application of the beam are entered. In step 1.1 a beam type may be selected from a library of predefined beam types, or alternatively a customised beam type may be provided by the designer.

In steps 1.2 to 1.5, data on the beam size and load is provided. In step 1.2, it is specified the beam is a floor or roof beam, whether the beam is to be an internal beam or an edge beam, the distance to be spanned by the beam and the distance to adjacent beams on each side. The profile of the deck to be supported by the beam is then provided. Again, the profile may be selected from a library of predefined profiles or the parameters for a preferred profile may be provided. The floor plan is then entered including the orientation of the deck, the location and number of secondary beams and beam restraint details. Details of the concrete slab to be supported by the beam are then entered, including the depth of the slab, the type and grade of the components of the slab and of the reinforcement mesh provided in the slab.

At steps 1.6 and 1.7, the details of the load to be borne by the building are entered, including imposed, service and wind loading, any partial safety factors and the limits of the natural frequency and deflection of the structure.

In step 1.7, any load additional to those imposed by the floor plan and loading details are entered, both point loads and uniformly distributed loads. This input can be confirmed by displaying a configuration of a typical bay.

If shear connectors are to be used, the number and spacing are entered in step 1.8.

In steps 1.9, 1.10 and 1.11, parameters of the beam are provided, in particular, the top and bottom flange dimensions, the web depth and thickness and details of any change point in the beam, together with the number, spacing and size of any apertures in the web and the provision of any beam stiffeners.

At step 1.12, the required fire resistance time is entered conventionally selected from 30 minutes, 60 minutes, 90 minutes or 120 minutes, and partial safety factors for the fire limit applied.

The input stage thus allows the designer to provide the details of the beam shape, web openings, web stiffeners, beam geometry between change points and other parameters as desired. Such parameters may be selected from a library of predetermined shapes or parameters, or where the method is implemented on a computer program, may be determined by said program.

It may be envisaged, that where the method is implemented on a computer program or otherwise, suitable graphical displays may be provided to confirm the parameters entered.

Once the desired values for these parameters have been provided, the analysis stage is then performed.

Referring now to FIG. 5*b*, the analysis stage asks for further information as to whether the beam is composite or not and whether it is to be propped or not, and the steel grade. Checks for three calculation conditions are then performed in steps 2.2, 2.3 and 2.4 in FIG. 3.

Step 2.2 is the so-called "normal condition" where checks are made on the properties of the beam in situ in a finished building i.e. when the structure of which the beam is to form a part is complete. The ultimate limit calculations are performed for a plurality of properties at each of a plurality of discrete locations, in the present example 51 discrete sections through the beam disposed longitudinally spaced along the length of the beam. The sections may be equidistant from one another or may be spaced otherwise as necessary. In step 2.2, the applied load is first calculated and then four main properties calculated;

1) the vertical shear force on the beam and the bending moment, 2) the interaction of the bending moment and vertical shear, 3) the lateral torsional buckling of the beam, and 4) the concrete longitudinal shear resistance.

Further properties which may be calculated include any necessary transverse reinforcement, and the weld throat thickness.

The calculated values are compared to a predetermined criterion and a unity value calculated for the discrete section having the least acceptable calculated value of that property.

A unity value for a given property is a unitless value indicating whether the calculated value for a given property meets the predetermined criterion. If the unity value is greater than 1, this indicates a failure mode i.e. the calculated value fails to meet the predetermined criterion. A value of 1 shows that the value of the property exactly meets the predetermined criteria, and of less than 1 shows that the value of the property is more than sufficient to meet the criteria. In practice, optimisation of the design requires that each unity value be less than but approaching 1. The unity value may be calculated by calculating the ratio of the calculated value with actual forces in the element.

Where the beam comprises adjacent sections having differing tapers, properties relating to the stability of the web and flange at or near a junction between two such sections is calculated. The properties comprise:

1) the maximum change angle, i.e. the maximum difference in the angle of taper between the two sections,
2) the web buckling resistance, and
3) the web bearing resistance.

For the web buckling resistance and the web bearing resistance, the calculated value is compared to a predetermined criterion and a unity value calculated for the discrete section having the least acceptable calculated value of that property.

Where the web is provided with one or more apertures, further calculations are performed at a plurality of points, in the present example around the aperture.

Using the results of these calculations, a unity value for each of the following properties, each representing a failure mode, is calculated;

1) modified calculation of vertical shear,
2) interaction of vertical shear and bending moment,
3) Vierendeel capacity,
4) web buckling capacity, and
5) web post horizontal shear.

In the next step 2.3 of the analysis stage, the so-called "construction condition" the properties of the beam are checked for the condition when it is in situ but when no load, e.g. from a floor slab, is applied. The following properties are checked;

1) interaction of the bending moment capacity and vertical shear capacity in the absence of the concrete slab, and
2) the lateral torsional buckling of the beam.

Where apertures are provided in the web, the following properties are calculated for a section through the centerline of the or each aperture as in step 2.2 above;

1) modified calculation of vertical shear,
2) interaction of vertical shear and bending moment,
3) Vierendeel capacity,
4) web buckling capacity, and
5) web post horizontal shear.

Again, the calculated value for each property is compared to a predetermined criterion and a unity value calculated for the discrete section having the least acceptable calculated value of that property.

In step 2.4 of the analysis stage, the "serviceability condition", the following properties are calculated.

1) concrete compressive stress
2) steel tensile stress
3) steel compressive stress
4) natural frequency of vibration of the beam For each of these properties a unity value is calculated as in steps 2.2 and 2.3 above.

In the serviceability condition, a check may also be made on the deflection of the beam, The deflection checks may include, in the construction condition, the self weight deflection of the beam when propped or un-propped. In the normal condition, the deflection due to imposed loads and superimposed dead loads may be calculated on the basis of the composite beam properties, and a total deflection check be performed. The deflection checks in the present example do not generate a unity value, but are instead compared to predetermined criteria provided by the designer, for example the maximum acceptable total deflection of the beam. In the present example, the deflection checks are optional and any or all may be selected or omitted by the designer.

At step 2.4A, a fire resistance test is performed as described hereinbefore, using the beam parameters entered in steps 1.1 to 1.11, and an output generated.

At the display step 2.5, each property is displayed including the results of the fire resistance test 2.4A, together with the 'critical value' the corresponding unity value for a discrete section having the least acceptable calculated value of that property (usually the maximum value), or other indication of the comparison with a corresponding criterion, or calculated value for the property, as appropriate.

If at step 2.6 the critical values are acceptable, the designer proceeds to stage 3 of the method. Where a unity value exceeds 1 as in step 2.7, the value for that property in the relevant section is 'critical' and hence likely to lead to failure of the beam. The information thus displayed draws the designer's attention to where the beam is deficient. The designer may then revise the values of the parameters (step 2.7A) and supply the amended parameters at the input step 1.10. To vary the fire resistance of the beam the designer may modify the dimensions of the beam, or vary the coating thickness or modify the size of parts of the structural beam, or add stiffeners or any combination of these.

The designer then returns to the input stage to modify the beam details accordingly.

However, when a unity factor is substantially below 1 (step 2.8), this indicates that the beam is over-designed for the intended load. To reduce beam weight, cost etc. it is desirable to increase the unity factor towards 1 whilst remaining below 1, thus optimising the design. The information displayed thus permits the designer to quickly identify those sections of the beam where the design can be optimized and revise the beam parameters accordingly (step 2.8A). The revised beam parameter values are entered at step 1.10.

The process of revising the beam parameters and viewing the calculated unity factors can be performed iteratively until, at step 2.6, the critical factors are acceptable, i.e. the unity factors are all below 1 but sufficiently close thereto for the design to be sufficiently optimized and the method proceeds to the output stage.

At the output stage, as shown in FIG. 5*c* the details are output at step 3.1, for example by saving to a data file, or in any other format as desired. When the beam parameters are output, the parameters may be supplied as a printed document, in for example a standard format, or may be supplied as a computer data file in an appropriate format, for example on a computer disc, or tape, or any other medium, or displayed on a screen, or in any form as desired. It might be envisaged that such a data file could be, for example, transmitted by email to the client and/or to the beam fabricator. At step 3.2, the process is then repeated for all beams for which design is required. Finally, at step 3.3 when the parameters for all desired beams are all specified, it might be at this stage that a supplier may be contacted for details of the design, supply and fabrication costs of the beams, or the closest match from a library of predetermined beam types may be indicated and selected accordingly.

When an appropriate final design is arrived at, a cost may be calculated for a structural beam according to the design, fabrication drawings prepared, or indeed a manufacturing apparatus be controlled to fabricate a structural beam according to the design. Such a manufacturing apparatus may for example comprise cutting means to cut sheet metal to provide a web part and/or flange parts of desired shape, and may further cut apertures in the web part. The manufacturing apparatus may further or alternatively comprise welding means to join the web part and flange parts to form a beam. Such an apparatus is disclosed in our co-pending application no. GB9926197.6. Of course, any appropriate manufacturing apparatus may be used as desired. Where the method is performed using a computer program, the computer may be provided as part of a manufacturing means comprising said manufacturing apparatus.

The provision of a plurality of standard beam parameters in a library as part of the program thus further accelerates the design process by providing that some or all of the parameters of the beam need not be supplied by the designer.

The temperature information and modifying factor information is preferably stored as computer-readable files, such that where the method is performed by a computer program, the computer program is able to read the required temperature information and modifying factor information and perform the analysis accordingly without further invention from a designer.

Any appropriate intumescent material may be used as desired. Generally, intumescent coating material may be applied in the thickness in the range 0.2 mm to 2.2 mm, although any appropriate material and thickness may be used depending on application process to be used and the characteristics of the particular intumescent coating material to be used.

Assessing Fire Resistance of Beams

The fire resistance of a fabricated steel beam is assessed by a modification to that used in normal conditions. The procedure, therefore, generally follows the step-wise approach. The main difference is that the material properties used are those are appropriate to elevated temperatures. Reduced partial factors for material strengths and loads appropriate for the fire limit state are taken from BS 5950-8.

The temperature of parts of the cross-section depend on the amount of fire protection applied and the required fire resistance. In this example, the beams must be protected with the special intumescent coating, "Firetex FB 120", developed by W and J Leigh.

Three loaded fire resistance tests on protected composite beams were carried out at Warrington Fire Research Center (WFRC) and numerous unloaded short sections have been tested at WFRC and W and J Leigh's test furnace at Bolton. Based on these tests, a mathematical model of the performance of steel sections protected with "Firetex FB 120" has been developed. Using this model, the temperature distribution on any section may be obtained. From the temperature distribution, the reduced shear, global bending and Vierendeel bending resistance of openings may be calculated.

An important feature of the thermal model is its ability to allow users of the Fbeam software to optimize the design of the beam so that the thickness of protection can be applied in one coating. The maximum thickness that can be applied in one coating is approximately 1.5 mm. The software will warn users if the necessary thickness is greater than this maximum thickness so that the user can change the beam design, e.g. increase the web thickness. Thicknesses greater than 1.5 mm will normally have to be applied in two coatings resulting in considerable increase in cost of the fabricated steelwork.

The structural model used to assess the resistance to local and global actions is described in Section 2 and the development of the thermal model is described in Section 3. The recommendations only apply to composite beams and do not apply to non-composite or tapered beams.

1. Fire Test Program

The purpose of the test program was to investigate the behavior of composite fabricated beams with web openings in fire and to establish the necessary thickness of fire protection to achieve 120 minutes fire resistance. The test program consisted of three fire protected loaded beam fire tests at WFRC supplemented by a number of unloaded fire protected short beams which were tested alongside the loaded beams at WFRC and in W and J Leigh's own furnace.

In the first two tests, the applied thickness of intumescent coating was slightly greater than the 1.5 mm which can normally be applied in one coat. However the thickness of protection in the third test was very close to 1.5 mm.

The main details of these tests are now summarised, as follows:

1.1 Beam Test 1

Figure 6:
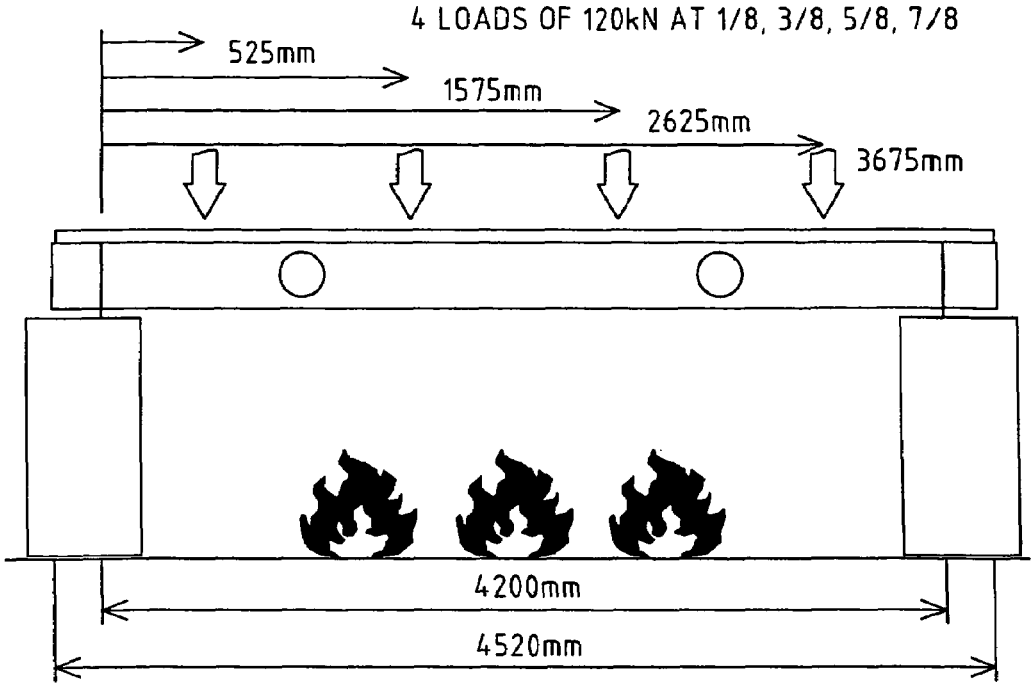
FIG. 6 is an illustration of an arrangement of a test of a beam.

The general arrangement of the test on a fabricated steel beam with circular openings is shown in FIG. 6. The beam details were:

| | |
|---|---|
| Depth of steel beam | 400 mm |
| Top flange | 200 mm × 15 mm |
| Bottom Flange | 200 mm × 35 mm |
| Web thickness | 12 mm |
| Steel grade* | S275 |
| Composite Slab | 1200 mm wide × 120 mm deep<br>Grade 30 concrete<br>51 mm deep Holorib steel decking<br>A193 mesh reinforcement |
| Shear connectors | 2 19 mm diameter studs @ 150 centers |
| Openings, on center of web at quarter points | 2 × 240 mm diameter |
| Fire protection | 1.84 mm FB 120 (average thickness) |

Four equal point loads of 120 kN were applied to the beam. Under this loading the critical structural condition for normal design was in the region of the openings rather than overall bending of the beam, which is usually the controlling condition.

Figure 7:
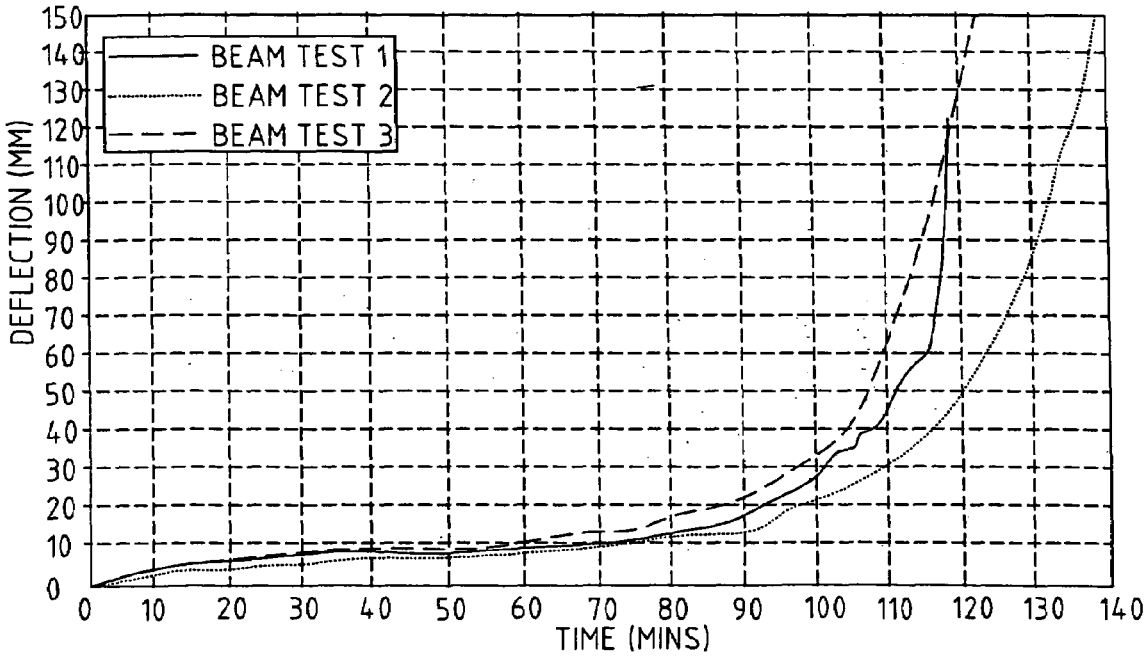
FIG. 7 is a graph showing deflection of tested beams.
Figure 8:
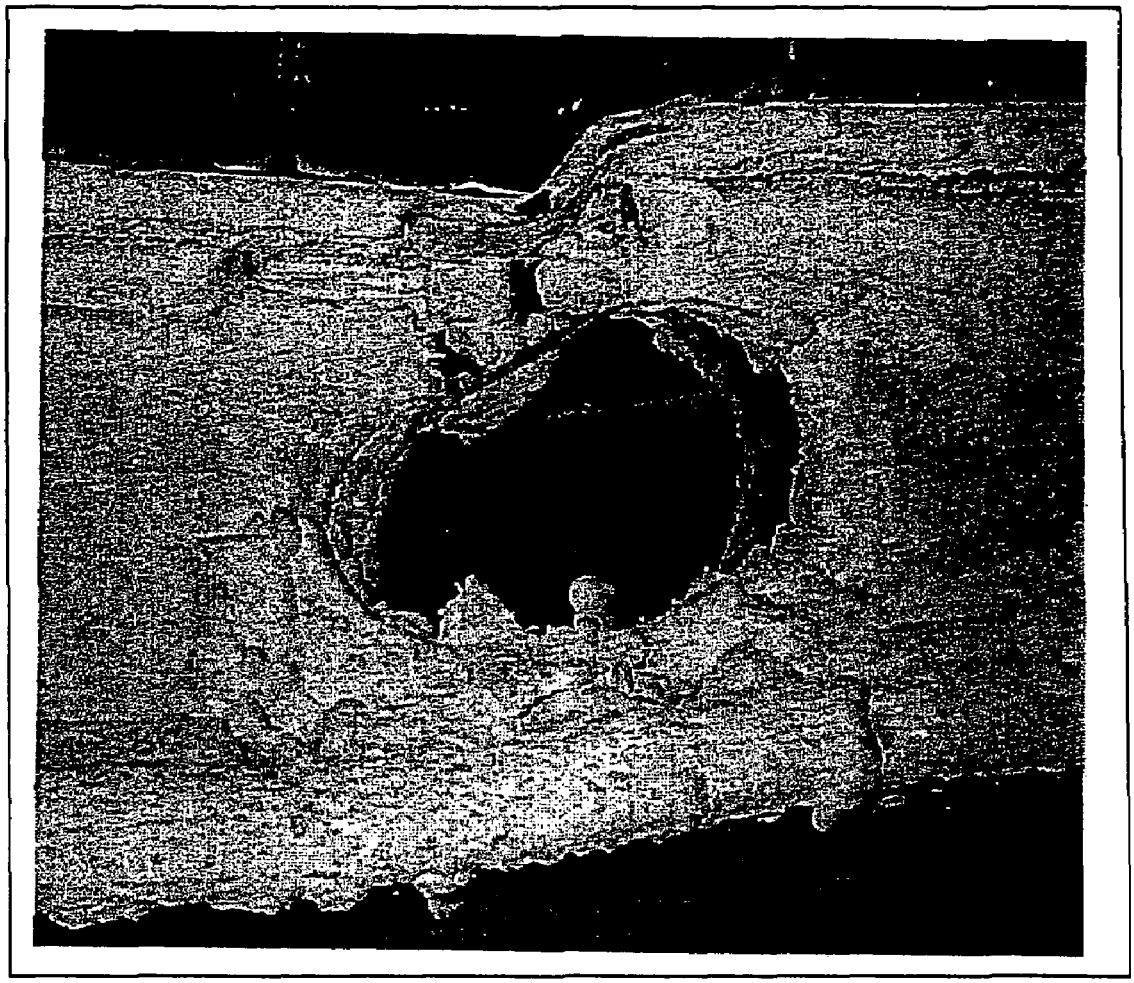
FIG. 8 is a photograph of a shear failure in a tested beam.

The beam failed after 117 minutes due to excessive deformation of approximately span/30. The deformations recorded in all three tests are shown in FIG. 7. The deflection increased rapidly when a shear failure occurred at one of the openings, as illustrated in FIG. 8.

At failure, the average bottom flange temperature was 700° C. and the web temperature remote from the opening was 715° C. The temperature of the web at 20 mm from the edge of the opening was 875° C.

1.2 Beam Test 2

The general arrangement of the test was similar to Beam Test 1, except that the two openings were rectangular and one opening had both top and bottom stiffeners. The beam details were:

| | |
|---|---|
| Depth of steel beam | 400 mm |
| Top flange | 200 mm × 20 mm |
| Bottom flange | 200 mm × 45 mm |
| Web thickness | 15 mm |
| Steel grade | S275 |
| Composite Slab | 1200 mm wide × 120 mm deep<br>Grade 30 concrete<br>51 mm deep Holorib steel decking<br>A193 mesh reinforcement |
| Shear connectors | 2 19 mm diameter studs @ 150 centers |
| Openings, on center of web at quarter points | 350 mm long × 200 mm high, unstiffened<br>450 mm long × 175 mm high, stiffened with both sides with 50 × 6 steel plates |
| Fire protection | 2.01 mm FB 120 (average thickness) |

In order to ensure that 120 minutes fire resistance was achieved, the applied loading was reduced to 110 kN at each point. Under this loading the critical structural condition for normal (cold) design was again in the region of the openings. Rectangular openings may be expected to fail in Vierendeel (local) bending due to the transfer of shear forces.

Figure 9:
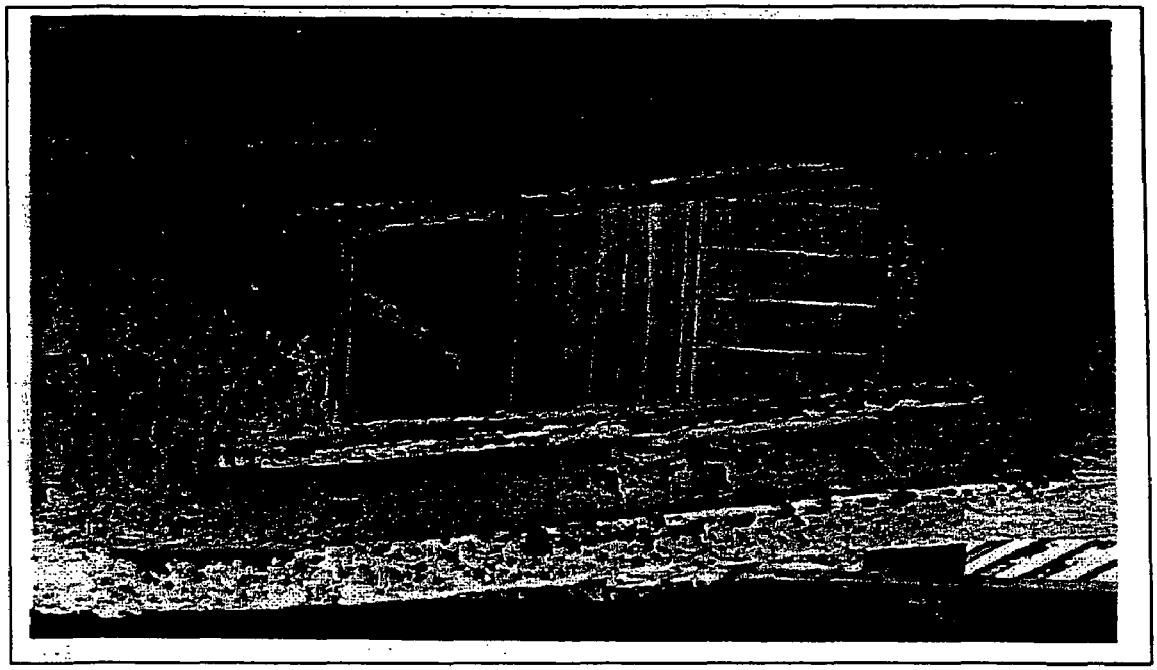
FIG. 9 is a photograph of deformation of a tested beam.

The beam failed after 135 minutes due to excessive deformation (FIG. 7). At failure both openings were beginning to show signs of Virendeel bending failure (FIG. 9).

At failure, the average bottom flange temperature was 730° C. and the web temperature remote from the opening was 780° C. The temperature of the web 20 mm from the edge of the opening was 900° C.

1.3 Beam Test 3

The test was very similar to Beam Test 1, except that the two circular openings were slightly larger and were fitted with ring stiffeners. The clear internal diameter of the opening was the same as in the first test. The beam details were:

| | |
|---|---|
| Depth of steel beam | 400 mm |
| Top flange | 200 mm × 15 mm |
| Bottom flange | 200 mm × 35 mm |
| Web thickness | 12 mm |
| Steel grade | S275 |
| Composite Slab | 1200 mm wide × 120 mm deep<br>Grade 30 concrete<br>51 mm deep Holorib steel decking<br>A193 mesh reinforcement |
| Shear connectors | 2 19 mm diameter studs @ 150 centers |
| Openings, on center of web at quarter points | 2 × 240 mm diameter ring stiffener. |
| Fire protection | 1.52 mm FB 120 (average thickness) |

The thickness of fire protection was reduced to 1.52 mm and the point loads were reduced to 100 kN to ensure that 120 minutes fire resistance could be achieved. Under this loading the critical structural condition for normal (cold) design was again in the region of the openings.

Figure 10:
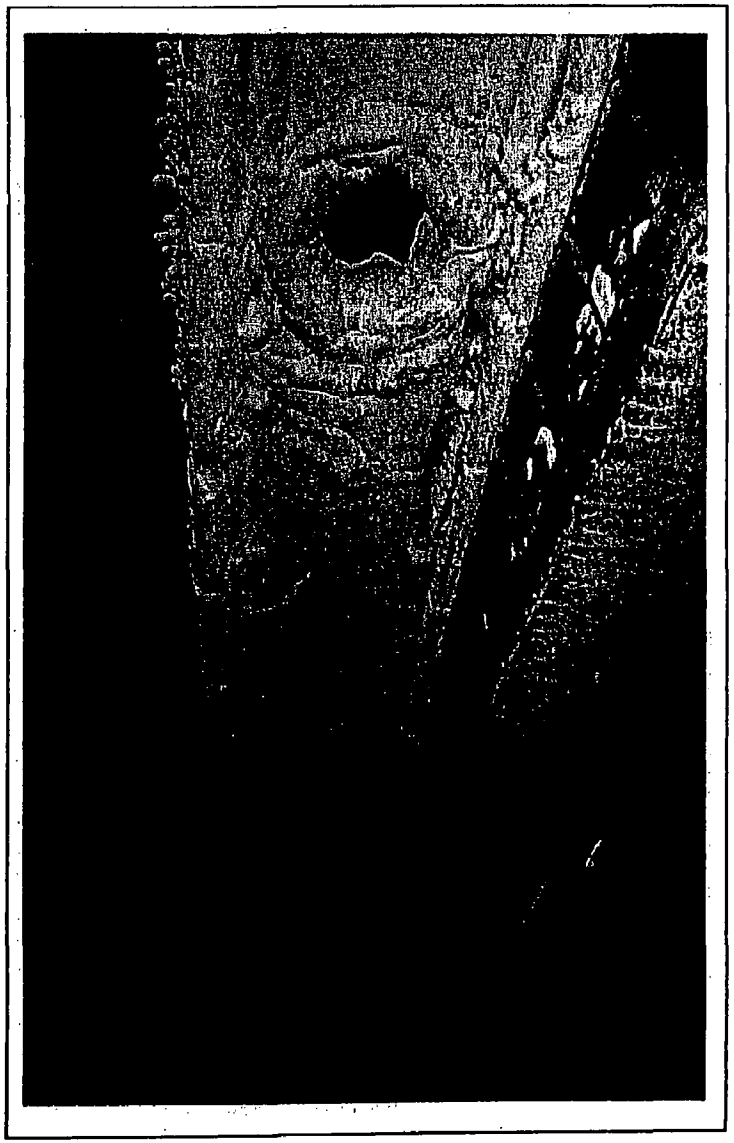
FIG. 10 is a photograph of bending failure of a tested beam.

The beam failed after 121 minutes due to excessive deformation. However, in this test there appeared to be no local deformation at the openings and failure was by overall beam bending (FIG. 10).

At failure the average bottom flange temperature was 733° C. and the web temperature a distance from the opening was 785° C. The ring stiffeners had the effect of the reducing the temperatures recorded close to the openings.

1.4 Unloaded Tests

Data on the performance of the protection material was collected in 13 tests on unloaded short sections and the three loaded beam tests. The sections sizes and protection thickness for all these tests are summarised in Table 1.

In all but one of the tests the intumescent coating performed in a predicable manner for up to and beyond 120 minutes. In test T1 A, which had the thinnest coating of approximately 0.6 mm, the steel temperature rose rapidly after 85 minutes indicating that the coating had become detached (a stickability failure).

TABLE 1

Summary of details of all protected sections

| | | Steel thickness (mm) | | | Protection thickness (mm) | | |
|---|---|---|---|---|---|---|---|
| Ref | Openings | Bottom Flange | Web | Top Flange | Bottom Flange | Web | Top Flange |
| | | Tests at W and J Leigh | | | | | |
| 4410 | None | 45 | 15 | 20 | 1.17 | 1.27 | 1.27 |
| 4412 | None | 35 | 12 | 15 | 1.57 | 1.34 | 1.34 |
| 4429 | Circular | 35 | 12 | 15 | 1.56 | 1.73 | 1.73 |
| 4430 | Rect (s) | 45 | 15 | 20 | 1.42 | 1.48 | 1.48 |
| 4432 | Rect | 35 | 12 | 15 | 1.45 | 1.41 | 1.41 |
| 4433 | Rect (s) | 35 | 12 | 15 | 1.56 | 1.44 | 1.44 |
| 4447 | None | 35 | 12 | 15 | 1.15 | 1.05 | 1.05 |
| 4449 | Rect | 35 | 12 | 15 | 1.14 | 1.09 | 1.09 |
| 4482 | None | 35 | 12 | 15 | 1.20 | 1.09 | 1.09 |
| | | Tests at Warrington Fire Research Center | | | | | |
| T1 | 2 Circular | 35 | 12 | 15 | 1.76 | 1.78 | 1.7 |
| T1 A | None | 45 | 15 | 20 | 0.59 | 0.61 | 0.54 |
| T2 | 2 Rect (s) | 45 | 15 | 20 | 1.59 | 1.83 | 1.65 |
| T2 A | None | 15 | 10 | 15 | 1.82 | 1.5 | 1.7 |
| T3 | 2 Circ (s) | 35 | 12 | 15 | 1.48 | 1.49 | 1.49 |
| T3 A | None | 15 | 10 | 15 | 1.48 | 1.52 | 1.52 |
| T3 B | None | 25 | 10 | 15 | 1.49 | 1.52 | 1.52 |

Note:
Circular refers to circular opening(s) 240 mm diameter
Rect refers to rectangular opening(s)
T1, 2, 3 refer to loaded beam tests
T1 A etc refers to unloaded short beam sections
(s) refers to stiffened opening(s)

2. Structural Model

The design rules are expressed in a step by step in a manner similar to that followed for normal design. The rules have been developed by SCI and follow the principles of BS5950-8 and EC4-1-2.

2.1 Bending Resistance of Plain Beam

The bending resistance of a beam is calculated using plastic bending theory.

The plastic neutral axis of a composite beam may be determined by equating the compression and tensile forces in the concrete and steel elements, such that:

$$\sum_{i=1}^{n} A_i p_{y,\theta,i}^{+/-} + \sum_{i=1}^{m} A_i f_{c,\theta,i,} = 0$$

where:

$A_i$ is the area of element i.

$P_{y,\theta,i}$ is the effective yield strength of steel element i.

$f_{c,\theta,i}$ is the design strength of concrete element i at temperature θ. Tension in concrete is ignored.

The design moment of resistance, Mfi,t,Rd, of a composite beam may be determined by taking the moment of each element about the plastic neutral axis, as follows:

$$M_{fi,t,Rd} = \sum_{i=1}^{n} A_i z_i p_{y,\theta,i} + \sum_{i=1}^{m} A_i z_i f_{c,\theta,i}$$

where:

zi is the distance of element I measured to the plastic neutral axis.

Partial shear connection is taken into account in the similar manner to that employed for normal design. In fire, the resistance of shear connectors is based on a temperature equal to 80% of the top flange temperature. The compressive force in the concrete is limited by the resistance of the shear connectors from the support to the point under consideration.

7.2.2 Shear Resistance of Plain Beam

In fire, the total shear resistance is made up of contributions from the concrete slab, the top flange and the web. The contribution of the bottom flange to the shear resistance is generally small and is ignored.

$$V_{overall}=V_{slab}+V_{topflange}+V_{web}$$

Slab Contribution

The shear resistance of the solid portion (above the steel deck) of the concrete slab is considered to act over an effective width of 3 ds, where ds is the slab depth, and is given by:

$$V_{slab} = 3v_c k_c \times d_s d_{top} \times \left(\frac{1.5}{1.3}\right)$$

where:

vc shear strength of lightly reinforced slab in normal conditions kc concrete strength reduction factor (see below)

ds depth of composite slab dtop Depth of concrete above the steel deck

The ratio of 1.5:1.3 comes from the different partial factors for concrete strength in normal and in fire conditions.

The strength reduction factor for concrete, kc, is assumed to vary with fire resistance time as follows:

TABLE 2

Effective concrete strength reduction factor

| Fire resistance (mins) | Effective strength reduction factor for concrete, kc |
|---|---|
| 30 | 1.0 |
| 60 | 0.9 |
| 90 | 0.8 |
| 120 | 0.7 |

Top Flange Contribution:

The shear resistance of the top flange is based on the web thickness and two lengths of weld (assumed to be 16 mm) and is given by:

$$V_{topflange}=0.6p_{y,\theta}t_{fi}(16+t_w)$$

where:

tf is the thickness of the top flange tw is the web thickness $p_{y,\theta}$ is the reduced strength of the steel at flange temperature θf Web Contribution:

The shear resistance of the web is given by:

$$V_{web}=0.6\times A_v p_{y,\theta}$$

where:

Av is the shear area of the web, $p_{y,\theta}$ is the reduced strength of the steel at web temperature, θw The effective web thickness for bending checks of the web-flange sections should be reduced in the presence of high shear force, as follows:

$$t_{eff} = t_w\left[1-\left(\frac{2V_{0,fire}}{V_{total}}-1\right)^2\right] \text{ for } \frac{V_{0,fire}}{V_{total}} \geq 0.5$$

where:

teff is the effective web thickness tw is the actual web thickness

Vtotal is the total shear resistance of the section

For low shear regions, teff=t.

2.3 Shear Resistance of Beam With an Opening

At an opening, the total shear resistance of the web is in two parts.

Web Contribution:

For an unstiffened web, the shear resistance is given by:

$$V_w=0.6\times(A_{v1}p_{y,\theta,1}+A_{v2}p_{y,\theta,2})$$

where:

$A_{v1}$ is the shear area of the upper web $A_{v2}$ is the shear areas of the lower web $p_{y,\theta,1}$ is the effective yield strength of the upper web at temperature θ1

$p_{y,\theta,2}$ is the effective yield strength of the lower web at temperature θ2

2.4 Bending Resistance

Figure 11:
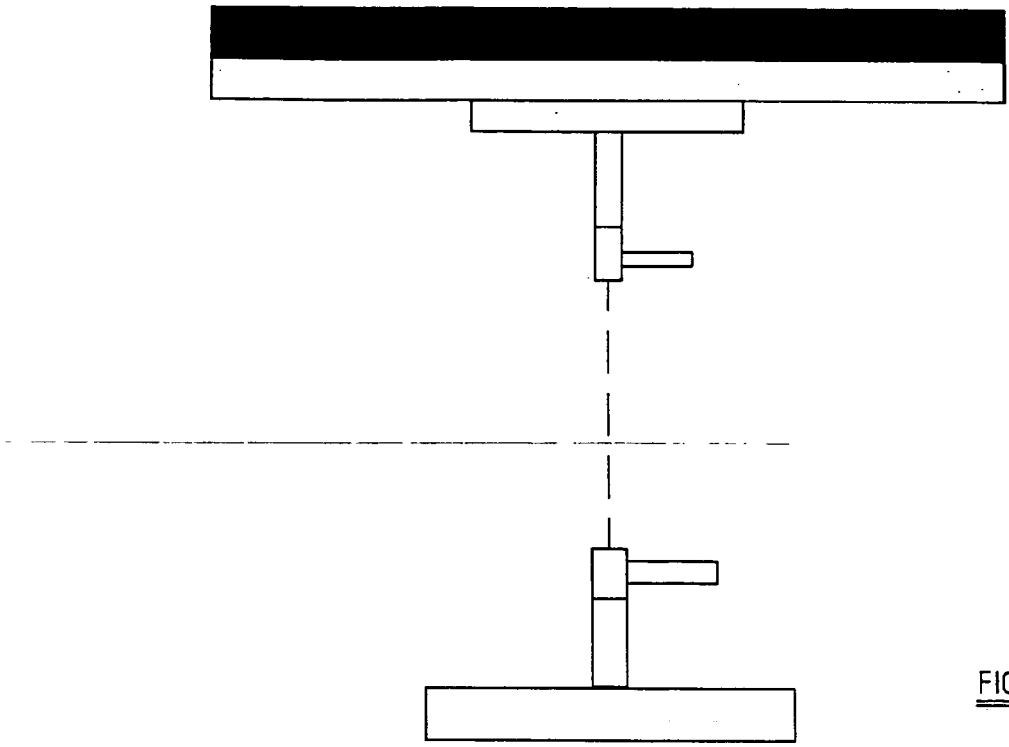
FIG. 11 is a division of a cross section of a beam into elements.

The bending resistance of the cross section at an opening is calculated using plastic bending theory as described in Section 2.1. The web thickness is taken as $t_{eff}$ and any suitably welded horizontal stiffeners are included. The section is divided up into up to 9 elements (FIG. 11) and the calculation takes into account the temperature and strength of each element. Any concrete at the level of the steel decking is ignored.

2.5 Vierendeel Bending

The Vierendeel bending resistance of an opening is given by the sum of the 4 bending resistances at the corners of the opening calculated using $t_{eff}$. At the top of the section one of these resistances includes a contribution from the composite slab. All the other 3 resistances are due to the steel Tee sections. The total Vierendeel bending resistance is therefore:

$$M_v=M_{vc,\theta}+M_{t,\theta}+2\times M_{b,\theta}$$

These bending resistances are calculated using the method given in Section 7.2.1, using the temperature dependent material strengths.

The Vierendeel bending resistance of the lower web-flange section ($M_{b,\theta}$) is reduced by the presence of shear and tensile forces, and is given by:

$$M_{b,\theta,eff} = M_{b,\theta}\left[1 - \frac{M_o}{M_{fi,Rd}}\right]$$

Figure 12:
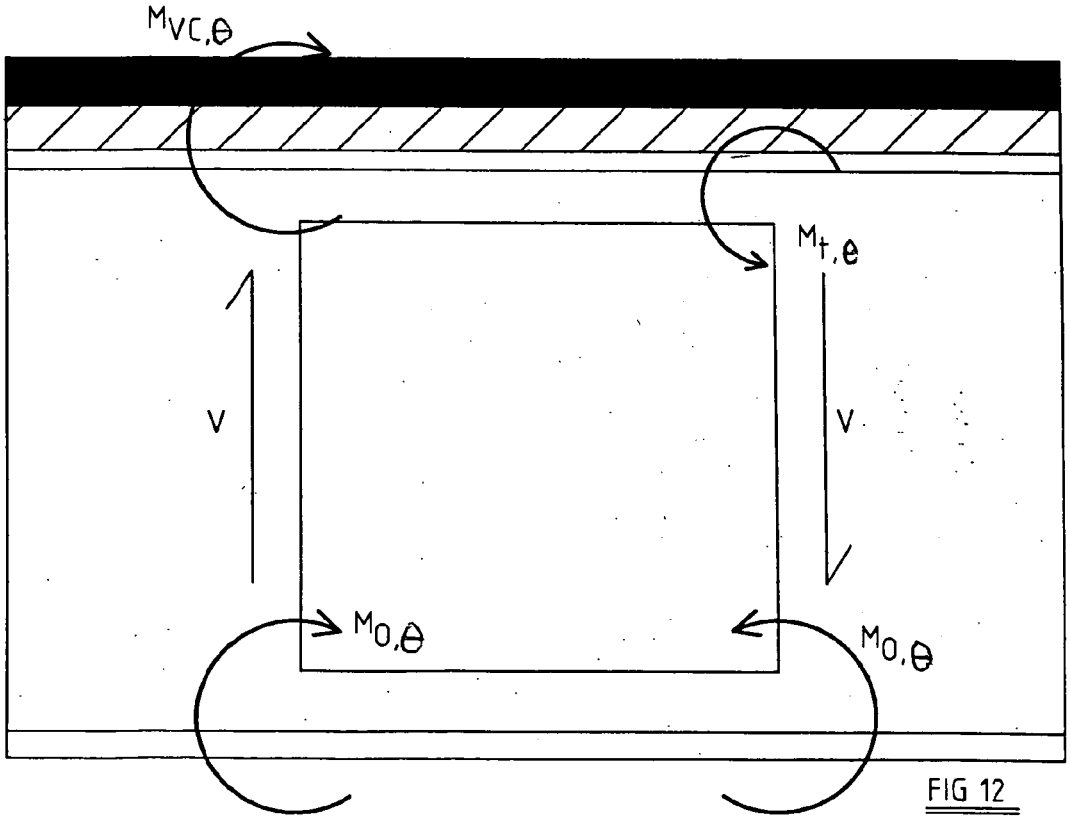
FIG. 12 illustrates a Vierendeel bending model.

The Vierendeel bending resistance of the non-composite upper web-flange section is also reduced by the presence of shear and axial force. FIG. 12 Vierendeel bending model used in fire The axial load effect is small when the section is close to the plastic neutral axis and, in fire, any reduction is ignored. Although this is a slightly unconservative approach, other conservative balancing assumptions are made. The largest of these is the beneficial effect of the tensile resistance of the reinforcement which is not included.

The shear effect is taken into account by limiting the depth of an unstiffened web so that the remainder can be classified as Class 2. The rule used for normal design is adopted in fire.

The Vierendeel bending resistance of the composite section above the opening is calculated assuming that only the number of shear connectors provided in a length (l+Ds) above the opening, where Ds is the depth of the slab.

The applied Vierendeel moment is $V_{o,fi}l$, where l is the effective length of the opening and $V_{o,fi}$ is the shear force at the center of the opening at the fire limit state.

For equilibrium:

$$M_v \geq V_o l$$

As in normal design, the minimum shear force is taken as 15% of the maximum shear force at the ends of the beam in order to take account of asymmetry of loading.

2.6 Web Buckling

The unstiffened vertical edge of an opening should be checked by buckling as a strut, by considering a compression force of Vt acting over an effective width of web. The effective width is assumed to be equal to that taken for normal temperatures but the shear force, Vt, is the shear force transferred by the web only above the opening.

In fire, web buckling is checked using a modified buckling curve and elevated temperature properties for effective yield strength and elastic modulus.

3. Thermal Model

The purpose of the thermal model is to enable the temperature of various parts of a beam to be predicted for fire resistances of 30, 60, 90 and 120 minutes and for practical thicknesses of Firetex FB 120.

The fire test results were analysed using various methods. The best correlation was made using a method which defines an effective thermal conductivity for the intumescent coating. This effective thermal conductivity changes during a fire resistance test and was found to depend on the coating thickness, the steel temperature and the section factor (A/V) of the coated part.

The method of analysis is based on a method given Eurocode 3, Part 1.2 (EC3-1-2) and in ENV13381-4. In both these codes the incremental rise in temperature of the steel is given by the differential equation:

$$\Delta\theta_s = \frac{\lambda_i / d_i}{C_a \rho_a}\frac{A_i}{V}\left[\frac{1}{1+\frac{2}{3}\xi}\right](\theta_t - \theta_s)\Delta t - \left(e^{\frac{\xi}{3}} - 1\right)\Delta\theta_t$$

$\Delta\theta_s$=incremental increase in steel temperature (° C.)
$\lambda i \rightarrow$=thermal conductivity of protection material (W/m° C.)
di=thickness of protection material (m)
$C_a$=specify heat of steel (J/kg° C.)
$C_i$=specific heat of protection material (J/kg° C.)
$\rho_a$=density of steel (kg/m3)
$\rho_i$=density of protection material (kg/m3)
Ai/V=section factor (m−1)(i.e. Hp/A)
θt=ambient gas temperature at time t(° C.)
θs=steel temperature at time t(° C.)
Δt=time interval(s)
Δθt=increase of the ambient temperature Δt(° C.)

The fire temperature, θt, is taken as the standard fire to BS 476.

Figure 13:
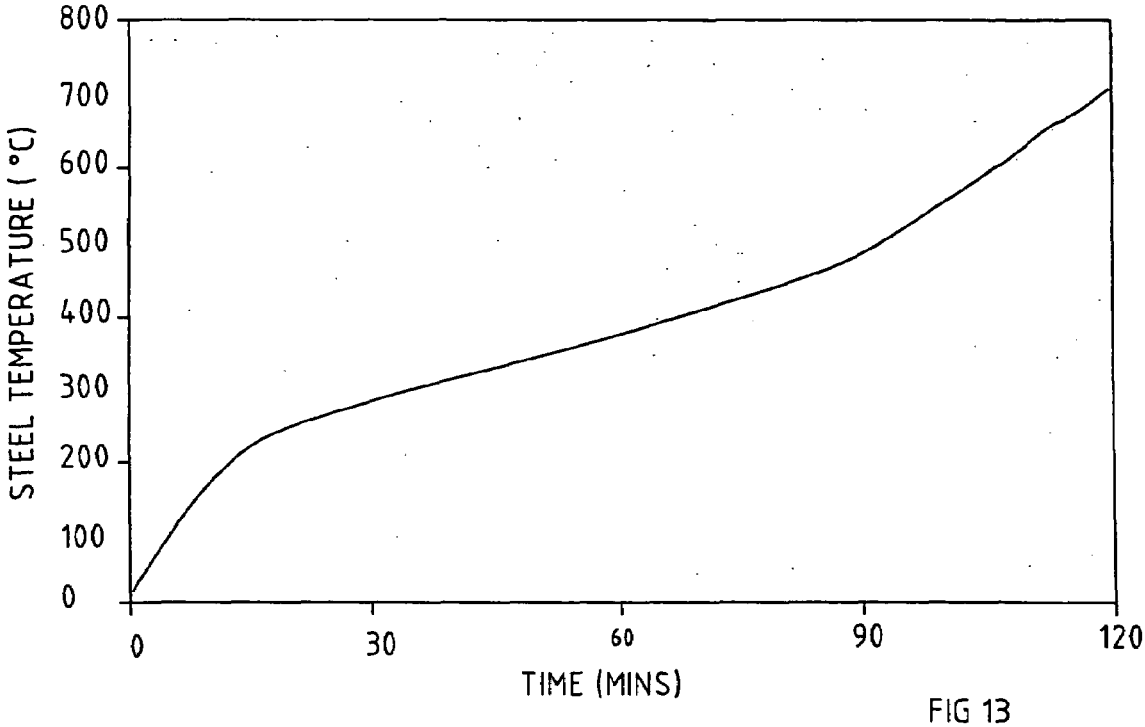
FIG. 13 is a graph showing the rise in steel temperature of a structural beam provided with an intumescent coating.

During the tests the temperature of various parts of beam were recorded (FIG. 13).

A feature of the performance of an intumescent coating is it does not start to intumesce (expand) and protect the steel until the steel reaches about 200° C. After this temperature it becomes a very effective insulator and limits the rate of rise of steel temperature. This behavior can be seen from the temperature response in FIG. 13.

From this temperature data, the rate of rise in temperature may be derived and hence, using the above equation, the effective thermal conductivity may also be established. For an intumescent coating, the thickness will increase as the coating intumesces. As it is very difficult to measure the instantaneous thickness, a constant thickness, approximately equal to the maximum thickness, was assumed and was derived. This effective value was found to vary with steel temperature, nominal coating thickness and section factor of the coated part. A typical plot showing the variation of thermal conductivity is shown in FIG. 14.

Figure 14:
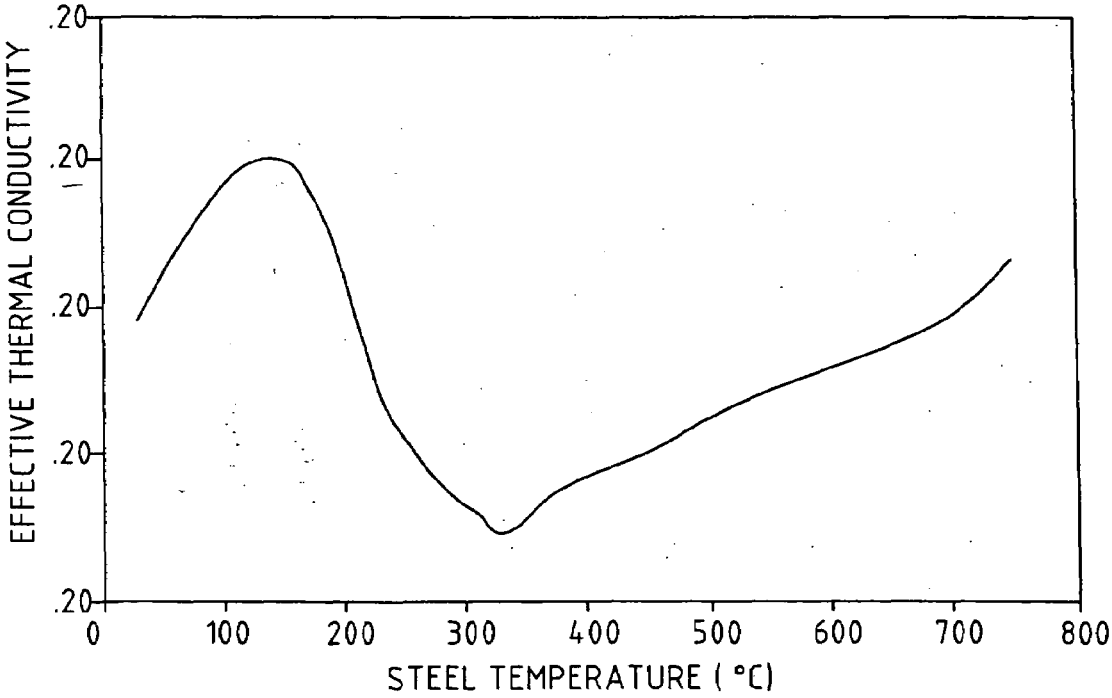
FIG. 14 is a graph showing the variation of effective thermal conductivity of an intumescent coating and steel temperature.

The behavior shown in FIG. 14 can be closely approximated by an initial phase in which the steel is only very lightly insulated and two phases in which the effective thermal conductivity is initially linearly falling and then linearly increasing. By analysing a number of sets of test data and carrying out regression analyses, the variation seen in these three phases can be expressed in terms of the section factor of the steel and the dry film thickness of the coating.

Separate analyses were carried out for the bottom flange, the web and the top flange.

4. Predicted and Measured Performance in Fire 4.1 Structural Performance

For each of the loaded fire tests, the predicted performance and the measured performance has been compared. The predicted strength of each beam at the end of each test has been assessed using the methods described in Section 7.2 using the measured steel temperatures. The results of these analyses are summarised in Table 7.3. In each case, the structural model correctly identified the mode of failure observed in the test. Also, the predicted load capacity of each beam was close to the applied load in the test.

In Test 1, the mode of failure was shear at one of the openings. The highest Unity Factor of 0.96 indicates that shear at the openings was identified as the governing mode.

In Test 2, the beam was showing signs of a Vierendeel bending failure at both openings. The highest Unity Factors of 1.00 and 1.01 indicate that Vierendeel bending at the openings was identified as the governing mode.

In Test 3, no local failures occurred and the beam was starting to fail in overall bending. The highest Unity Factor of 0.94 indicates that overall bending was identified as the governing mode.

In Test 3, circular openings were fitted with ring stiffeners. The effect of ring stiffeners has not been examined in any depth so the Vierendeel bending resistance, which is likely to be influenced by a ring stiffener, has not been computed. However, in Test 3 the ring stiffeners had the effect of containing the intumescent coating and thus reducing web temperatures. At the time of writing, ring stiffeners are not included in the scope of the FBEAM software for both normal and fire design conditions.

TABLE 3

Summary of applied loads and predicted resistances.

| | Test 1 | Test 2 | Test 2 | Test 3 |
|---|---|---|---|---|
| Beam checks | | (unstiffened) | (stiffened) | |
| Maximum applied moment | 260 | 238 | | 217 |
| Moment resistance | 312 | 312 | | 231 |
| Bending unity factor | 0.84 | 0.77 | | 0.94 |
| Hole checks | | | | |
| Applied shear | 124 | 114 | 114 | 103 |
| Total shear resistance | 129 | 142 | 153 | 165 |
| Shear unity factor | 0.96 | 0.80 | 0.74 | 0.63 |
| Applied moment | 195 | 179 | 179 | 163 |
| Moment resistance | 245 | 270 | 282 | 248 |
| Bending unity factor | 0.79 | 0.66 | 0.63 | 0.66 |
| Vierendeel bending resistance | 19.8 | 39.6 | 50.6 | |
| Applied Vierendeel moment | 14.8 | 39.7 | 51.1 | Outside Scope |
| Virendeel unity factor | 0.75 | 1.00 | 1.01 | |
| Applied web load | 14.5 | 20.6 | 25.1 | 19.4 |
| Web buckling capacity | 31.9 | 23.1 | 45.7 | 21 |
| Buckling unity factor | 0.46 | 0.89 | 0.55 | 0.92 |

4.2 Thermal Performance

Figure 15:
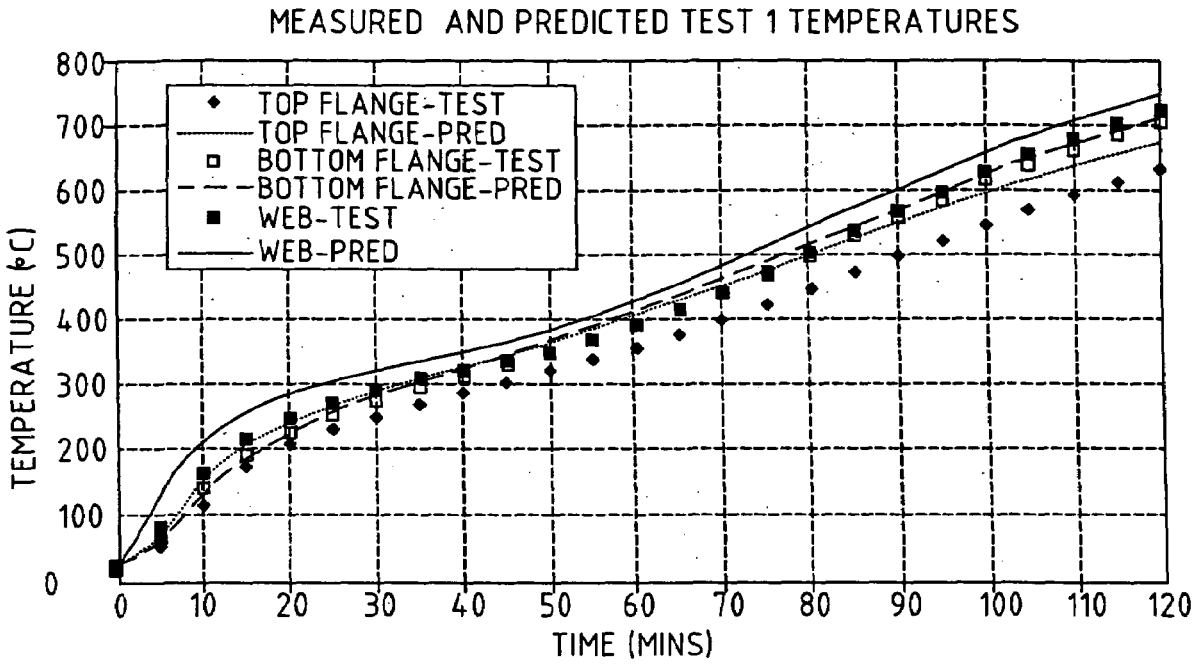
FIG. 15 is a graph showing comparison between measured and predicted temperatures in a first beam test.
Figure 16:
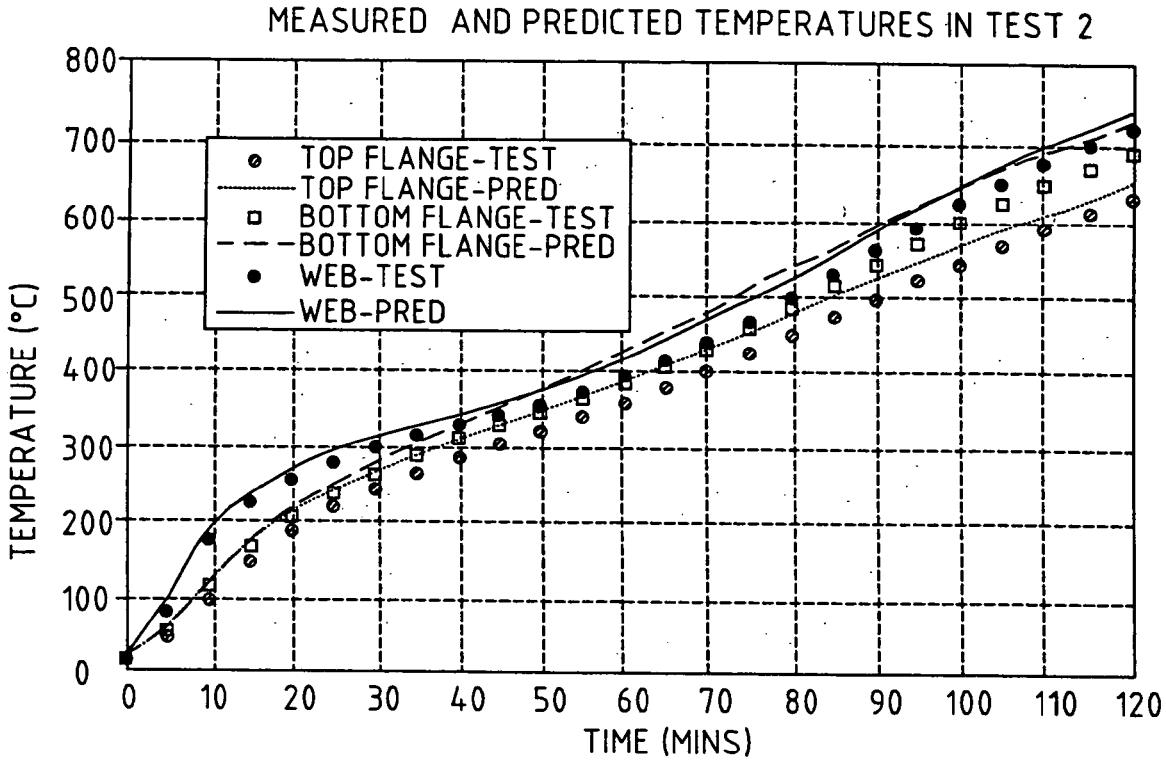
FIG. 16 is a graph showing comparison of measured and predicted temperatures in a second beam test.
Figure 17:
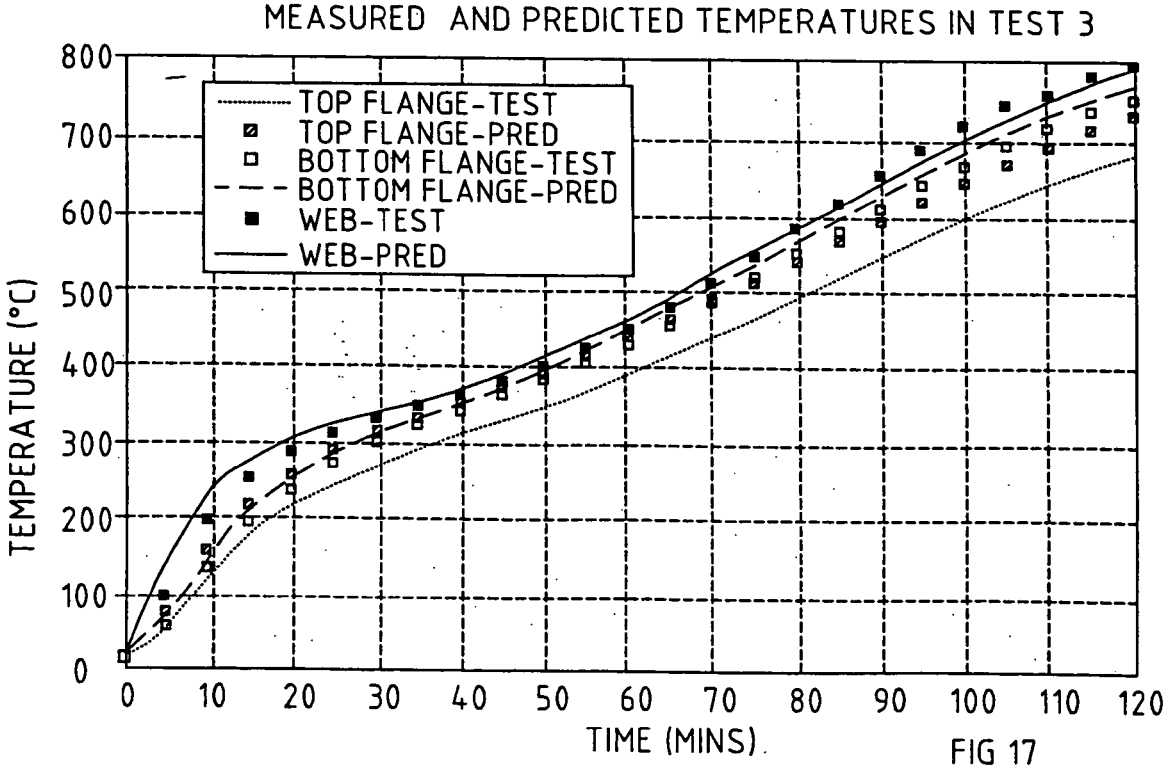
FIG. 17 is a graph showing a comparison of measured and predicted temperatures in a third beam test.

Comparisons between measured temperatures and predicted temperatures are shown in FIG. 15, FIG. 16 and FIG. 17. Generally, the predicted temperatures are higher than the measured values.

4.3 Summary of Comparisons

The comparisons shown in Sections 7.4.1 and 7.4.2 show that the structural and thermal models are adequate to predict the performance of Fabsec beams protected with Firetex FB 120. The differences between calculation and test are not significant. Also, in practical applications there are many inherently conservative factors which are not taken into account in the modelling. Actual material properties will be greater than the nominal properties which are used in calculations and the average applied thickness of coating will, invariably, be greater than the specified value.

In the present specification "comprises" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realizing the disclosure in diverse forms thereof.

The invention claimed is:

1. A method of designing a fire resistant structural beam including a plurality of apertures based on empirical temperature information obtained from conducting fire tests on a first fabricated beam and a second fabricated beam, the method carried out by a computer program and comprising:

obtaining a plurality of values for a plurality of physical parameters of the fire resistant structural beam;

selecting a fire resistance time for the fire resistant structural beam from a plurality of available fire resistance times;

reading temperature information associated with the selected fire resistance time, the temperature information comprising, or derived from, a plurality of temperatures measured at a plurality of locations on a first fabricated beam that is similar to the fire resistant structural beam and wherein the plurality of temperatures were obtained from a fire test of the first fabricated beam and measured after a time equal to the fire resistance time had elapsed, reading modifying factor information associated with the selected fire resistance time, the modifying factor information comprising at least one modifying factor for each aperture, wherein the modifying factor is derived from empirically obtained temperatures measured adjacent an aperture of a second fabricated beam that has undergone a fire test, performing an analysis comprising:

calculating a first property of the fire resistant structural beam at one or more locations on the fire resistant structural beam, the first property at each location calculated as a function of one of the plurality of temperatures of the temperature information, and calculating a second property of the fire resistant structural beam at a plurality of locations around the apertures and on the fire resistant structural beam, the second property at each location around the apertures calculated as a function of one of a plurality of temperatures obtained by multiplying the plurality of temperatures of the temperature information by the modifying factor, and generating an output indicating whether the fire resistant structural beam is likely to fail in accordance with the analysis step.

2. A method according to claim 1 wherein the temperature information for a position disposed between two or more of said locations is calculated by interpolating the temperatures at the two or more locations.

3. A method according to claim wherein the analysis comprises performing calculations at a plurality of spaced locations along the structural beam.

4. A method according to claim 3 wherein the spaced locations comprise sections through the structural beam.

5. A method according to claim 3 or claim 4 wherein the spaced locations are equidistant along the length of said structural beam.

6. A method according to claim 1 wherein the structural beam comprises a plurality of apertures and the step of obtaining a plurality of values for a plurality of physical parameters of the structural beam comprises obtaining aperture information comprising the location and size of each aperture.

7. A method according to claim 1 wherein the modifying factor information comprises a plurality of modifying factors at a plurality of locations and performing an analysis includes multiplying the temperature information by the modifying factor information.

8. A method according to claim 7 wherein the plurality of modifying factors are in the range 1.05 to 1.5.

9. A method according to claim 7 wherein the temperature information comprises empirical temperature information derived from heating the first fabricated beam comprising a beam having a plain web and wherein the modifying factor information comprises empirical temperature information derived from heating the second fabricated beam having a web provided with one or more apertures.

10. A method according to claim 6 wherein the analysis further comprises performing additional calculations in the vicinity of the aperture.

11. A method according to claim 10 wherein the additional calculations comprise calculating one or more of; the shear resistance of the structural beam, the bending resistance of the structural beam, Vierendeel bending resistance, web buckling.

12. A method according to claim 1 further comprising calculating the required thickness of intumescent coating to avoid failure of the structural beam at a selected period of time.

13. A method according to claim 12 further comprising identifying a failure mode of the structural beam and calculating the thickness of intumescent coating required to avoid the failure mode.

14. A method according to claim 13 further comprising identifying the location where said failure mode occurs and calculating the required thickness at that location.

15. A method according to claim 12 comprising calculating the required thickness of intumescent coating for a plain beam and then performing the additional calculations in accordance with the required thickness.

16. A method according to claim 1 wherein the output comprises comparing one or more values of said one or more properties with a predetermined criterion and generating an output accordingly.

17. A method according to claim 1 comprising performing said analysis for the structural beam in the cold condition.

18. A method according to claim 1 comprising modifying the values for a plurality of physical parameters of the structural beam in accordance with the output and performing the method in accordance with the modified values.

19. A method according to claim 1, further comprising forming a fire resistant structural beam pursuant to that design.

20. A method according to claim 9 or 14, wherein the temperature information also comprises a plurality of temperatures at a plurality of locations, and where the temperature information for a position disposed between two or more said locations is calculated by interpolating the temperature at the two or more locations.

21. A method according to claim 6 wherein the analysis further comprises performing additional calculations in the vicinity of the aperture.

22. A method according to claim 1, wherein the temperature information comprises modifying factor information.

23. A method according to claim 22, wherein performing an analysis comprises calculating a strength of the structural beam at a temperature calculated using the modifying information.

24. A method according to claim 1, wherein generating an output comprises indicating whether the beam is likely to fail.

25. A system for providing a method of designing a fire resistant structural beam including a plurality of apertures based on empirical temperature information obtained from conducting fire tests on a first fabricated beam and a second fabricated beam, the system comprising:

a memory that stores computer-executable instructions in a tangible form; and a processor being adapted to the execute the computer-executable instructions, the computer-executable instructions comprising instructions for:

obtaining a plurality of values for a plurality of physical parameters of the fire resistant structural beam;

selecting a fire resistance time for the fire resistant structural beam from a plurality of available fire resistance times;

reading temperature information associated with the selected fire resistance time, the temperature information comprising, or derived from, a plurality of temperatures measured at a plurality of locations on a first fabricated beam that is similar to the fire resistant structural beam and wherein the plurality of temperatures were obtained from a fire test of the first fabricated beam and measured after a time equal to the fire resistance time had elapsed, reading modifying factor information associated with the selected fire resistance time, the modifying factor information comprising at least one modifying factor for each aperture, wherein the modifying factor is derived from empirically obtained temperatures measured adjacent an aperture of a second fabricated beam that has undergone a fire test, performing an analysis step comprising:

calculating a first property of the fire resistant structural beam at one or more locations on the fire resistant structural beam, the first property at each location calculated as a function of one of the plurality of temperatures of the temperature information, and calculating a second property of the fire resistant structural beam at a plurality of locations around the apertures and on the fire resistant structural beam, the second property at each location around the apertures calculated as a function of one of a plurality of temperatures obtained by multiplying the plurality of temperatures of the temperature information by the modifying factor, and generating an output indicating whether the fire resistant structural beam is likely to fail in accordance with the analysis step.

* * * * *